US008094016B2

(12) United States Patent
Nakazato et al.

(10) Patent No.: US 8,094,016 B2
(45) Date of Patent: Jan. 10, 2012

(54) STATUS DETERMINATION METHOD AND IMAGE FORMING APPARATUS

(75) Inventors: Yasushi Nakazato, Tokyo (JP); Kohji Ue, Kanagawa (JP); Osamu Satoh, Kanagawa (JP); Masahide Yamashita, Tokyo (JP); Jun Yamane, Kanagawa (JP); Masaichi Sawada, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 387 days.

(21) Appl. No.: 12/481,237

(22) Filed: Jun. 9, 2009

(65) Prior Publication Data

US 2009/0322524 A1 Dec. 31, 2009

(30) Foreign Application Priority Data

Jun. 25, 2008 (JP) ..... 2008-166640

(51) Int. Cl.
*G08B 21/00* (2006.01)

(52) U.S. Cl. ..... 340/540; 340/525; 340/691.1; 340/691.6; 235/462.1; 235/462.12; 347/9; 347/14

(58) Field of Classification Search ..... 340/540, 340/525, 691.1, 691.6; 235/375, 376, 462.1, 235/462.12; 399/24, 27, 29; 347/9, 10, 14
See application file for complete search history.

(56) References Cited

U.S. PATENT DOCUMENTS 5,606,408 A 2/1997 Yano et al.
5,638,159 A 6/1997 Kai et al.
5,740,494 A 4/1998 Shoji et al.
5,765,087 A 6/1998 Yano et al.
5,808,631 A * 9/1998 Silverbrook ..... 347/9
5,936,224 A * 8/1999 Shimizu et al. ..... 235/462.1
6,799,012 B2 9/2004 Shakuto et al.
6,819,892 B2 11/2004 Nakazato et al.
6,937,830 B2 8/2005 Satoh
6,987,944 B2 1/2006 Shakuto et al.
7,027,751 B2 4/2006 Miura et al.
7,103,301 B2 9/2006 Watanabe et al.
7,110,917 B2 9/2006 Matsuura et al.
7,184,674 B2 2/2007 Satoh et al.
7,218,879 B2 5/2007 Enoki et al.
7,444,097 B2 10/2008 Suzuki et al.
(Continued)

FOREIGN PATENT DOCUMENTS

JP 3-68385 3/1991
(Continued)

OTHER PUBLICATIONS

U.S. Appl. No. 12/487,835, filed Jun. 19, 2009, Nakazato, et al.

*Primary Examiner* — Hung T. Nguyen
(74) *Attorney, Agent, or Firm* — Oblon, Spivak, McClelland, Maier & Neustadt, L.L.P.

(57) ABSTRACT

A plurality of weak discriminators output determinations results about a status of an apparatus. Weight values are individually assigned to the determination results. By performing majority vote of the weighted determination results, the status of the apparatus is determined. The determination results are displayed on a single status indicating screen such that portions corresponding to a normal status are indicated in white while portions corresponding to an anomalous status are indicated in one or more colors other than white. The areas of the portions differ from one another depending on magnitudes of weight assigned to the determination results corresponding to the portions.

17 Claims, 22 Drawing Sheets

U.S. PATENT DOCUMENTS

| | | | |
|---|---|---|---|
| 2003/0020760 | A1 | 1/2003 | Takatsu et al. |
| 2005/0058474 | A1 | 3/2005 | Watanabe et al. |
| 2006/0294252 | A1 | 12/2006 | Shoji et al. |
| 2007/0258723 | A1 | 11/2007 | Nakazato et al. |
| 2008/0068639 | A1 | 3/2008 | Satoh et al. |
| 2009/0034990 | A1 | 2/2009 | Nakazato et al. |
| 2009/0041481 | A1 | 2/2009 | Iida et al. |

FOREIGN PATENT DOCUMENTS

| | | |
|---|---|---|
| JP | 2001-175328 | 6/2001 |
| JP | 2002-31987 | 1/2002 |
| JP | 3305026 | 5/2002 |
| JP | 2002-262010 | 9/2002 |
| JP | 2003-15476 | 1/2003 |
| JP | 2003-131852 | 5/2003 |
| JP | 2005-215383 | 8/2005 |
| JP | 2005-227518 | 8/2005 |
| JP | 4027578 | 10/2007 |
| JP | 2005-17874 | 1/2008 |

* cited by examiner

STATUS INDICATING SCREEN

STATUS INDICATING SCREEN

STATUS INDICATING SCREEN

STATUS DETERMINATION METHOD AND IMAGE FORMING APPARATUS

CROSS-REFERENCE TO RELATED APPLICATIONS

The present application claims priority to and incorporates by reference the entire contents of Japanese priority document 2008-166640 filed in Japan on Jun. 25, 2008.

BACKGROUND OF THE INVENTION

1. Field of the Invention

The present invention relates to a technology for determining a specific one type of statuses of an apparatus, such as an image forming apparatus, based on status data pertaining to the apparatus.

2. Description of the Related Art

When a failure that can be solved only by replacing parts or performing cleaning occurs in an apparatus such as an image forming apparatus, the apparatus inconveniently remains to be out of service until the failure is solved. Sudden failure of an electrophotographic image forming apparatus is likely to occur if regular maintenance is not appropriately performed. This is because an electrophotographic image forming apparatus contains a huge number of components has a complicated structure.

Not only wear resulting from normal operation but also other causes gradually degrade performance of an electrophotographic image forming apparatus and eventually lead to failure. The other causes are, for example, entrapment of a detrimental matter, such as paper dust, in the apparatus from outside, excessive agitation of toner, wear of a cleaning member such as a cleaning blade, degraded performance of a charging unit due to deposits on the charging unit, and random failure. The excessive agitation of toner, which can occur when the apparatus is operated in an unexpected manner or the like, results in an undesirable increase in viscosity of toner and/or separation of an external additive from toner. Such a failure of the apparatus manifests itself in the form of degradation in image quality in some cases. Examples of the degradation in image quality include streaks on an image extending in a moving direction of an image carrier, blurring of an image, streaks on an image extending perpendicular to the moving direction of the image carrier, spots on an image, a void, and dirty printing. Because the failure that can result in such degradation does not stop or hinder image forming operation performed by the image forming apparatus, the image forming apparatus continues to operate even in the anomalous status until a user of the apparatus visually checks a formed image and recognizes the anomalous status. The user who has recognized the anomalous status is required not only to repair the apparatus but also to perform image forming again to obtain properly-formed images. This is great waste of time and resources.

To this end, various methods of predicting occurrence of apparatus failure in advance have been proposed. Methods of predicting occurrence of a failure in an apparatus are generally classified broadly into a first group methods and a second group methods.

The first group methods include methods of monitoring information relating to an operation of an apparatus to make prediction depending on whether a period of service of the apparatus is near an end of an average usable period of the apparatus having been set in advance and the like. This approach is based on a premise that the longer an apparatus operates, the more likely a failure occurs in the apparatus as in the case where the apparatus is worn. More specifically, for example, an accumulative period of service of at least one of various components and devices of a photosensitive element and/or a developing device of the image forming apparatus is counted. A prediction that a failure is likely to occur in the image forming apparatus is made when the count value has reached a usable-limit count value. The usable-limit count value has been set in advance based on a result of a durability test or the like. Meanwhile, a usable period of an apparatus largely depends on its environment and operation method. However, because individual differences in environment and operation method are not taken into consideration in the first group methods, approaches of the first group are less accurate than those of the second group methods.

The second group methods include methods of making prediction based on pattern recognition by using condition data set as a pattern. The condition data set is specifically detected in an apparatus that is in a prefailure status. This method based on the pattern recognition can be performed, for example, by using multivariate analysis such as Mahalanobis-Taguchi system (MTS). In the second group methods, a prediction is made based on whether an apparatus is in a status that would lead to a failure. Accordingly, if it is possible to detect a specific prefailure status, this approach of the second group methods permits accurate prediction of a time when the apparatus actually requires a maintenance work without being affected by an environment and operation method of the apparatus.

Japanese Patent Application Laid-open No. 2005-017874 discloses a technique for predicting failure occurrence of an image forming apparatus by using the MTS. In this technique, a plurality of types of status data pertaining to an image forming apparatus is collected, an index value for use in determination as to whether a specific one type of the status of the image forming apparatus is anomalous is calculated from the status data, and whether a failure related to the specific type of the status is going to occur is predicted based on the index value. More specifically, in this technique, a large number of status data sets are collected from an image forming apparatus in a normal status or a test apparatus that has the same configuration as the image forming apparatus and in a normal status. A normal data set group (normal index data) is structured from the collected status data sets. A distance (index value) between the status data and an origin (average point of normal status data) is calculated. The distance indicates a relative position of the status data in a multidimensional space of the normal data set group. When the status data is deviated from a normal status to fall into a status where a failure is likely to occur, the correlation between the status data and the normal data set group in the multidimensional space is disturbed. In this case, the distance, i.e., the index value, increases. In contrast, when the image forming apparatus is in a normal status, the distance (index value) decreases. Hence, it is possible to determine how normal the image forming apparatus is based on the index value. In this manner, the technique disclosed in Japanese Patent Application Laid-open No. 2005-017874 permits to predict occurrence of a failure of an image forming apparatus in advance by detecting a relatively minor anomalous change that occurs antecedent to the failure. If occurrence a failure is predicted, a user can order a replacement part in advance or, in a case where repair is difficult to be performed by the user, order on-site repair by a service person in advance. This advantageously reduces downtime of the image forming apparatus. Furthermore, because only a component of which usable life is near its end and which has caused a minor anomaly is to be replaced, it is possible to avoid unnecessary replacement of another component whose remaining usable life is long, thereby avoiding an increase in maintenance cost.

Japanese Patent Application Laid-open No. 2005-227518 discloses a data collecting technique for collecting a plurality of data sets about a plurality types of statuses of an image forming apparatus. In this data collecting technique, the data sets are collected from a plurality of image forming apparatuses of the same model as that of a target image forming apparatus. The data sets are collected from the image forming apparatuses during their operation tests that are performed before shipping. A reference data group that includes all the data sets collected from the image forming apparatuses during the operation tests serves as an initial reference data group. An index-value calculating equation from which an index value for a specific one type of status is to be calculated is determined based on the initial reference data group. After an image forming apparatus delivered to a user has started operation, data is collected from the image forming apparatus and added to the reference data group at predetermined updating timing.

Some known methods determine a status of an apparatus by using a boosting method. The boosting method generally combines a plurality of less-accurate, weak discriminators into a highly-accurate discriminator. To predict various failures of an image forming apparatus by using this approach, whether a status of the image forming apparatus is a prefailure status is determined on a failure-by-failure basis. Examples of the failures include error operation of the image forming apparatus and defective printing. The prefailure status is a status that can serve as a sign of a failure of the image forming apparatus. To implement this approach, a plurality of types of status data is collected. Examples of the status data include a detection result of a sensor and data on operation control of devices that is converted into a numeric form. Whether the status data indicates a normal status or an anomalous status is determined by a weak discriminator on a status-data-by-status-data basis. A weight is assigned to each of determination results of the weak discriminators such that the more the status data is correlated with a failure, the greater the weight assigned to the status data is. By performing majority vote or the like of the weighted determination results, whether the image forming apparatus is in the prefailure status (anomalous status) or not (normal status) is determined.

Japanese Patent Application Laid-open No. 2002-262010 discloses a technique of displaying, when an anomaly is detected in an image forming apparatus, an indication of this effect on an operation panel.

When it is possible to predict occurrence of a failure in an apparatus based on determination as to whether the apparatus is in an anomalous status, a maintenance work can be performed before a failure actually occurs in the apparatus, thereby preventing a failure.

However, even when occurrence of a failure is predicted based on detection of an anomalous status, it is difficult to ensure that the failure is going to occur in near future without fail. Meanwhile, if unnecessary maintenance work is performed, it adds to the maintenance costs. Accordingly, even when a message is displayed to inform a user that an anomalous status has been detected as in the technique disclosed in Japanese Patent Application Laid-open No. 2002-262010, it is in many cases difficult to expect the user to perform a maintenance work before a failure actually occurs. However, if any trouble manifests itself to a user when a prefailure status is detected, the user can comprehend that the failure will occur in near future. This increases the possibility that the user performs a maintenance work. However, if nothing manifests itself to a user even when the prefailure status is detected, the user cannot comprehend that a failure will occur in near future. In this case, it is particularly difficult to expect the user to perform a maintenance work at a certain amount of cost before a failure actually occurs.

SUMMARY OF THE INVENTION

It is an object of the present invention to at least partially solve the problems in the conventional technology.

According to an aspect of the present invention, there is provided a status determination method of determining a status of an apparatus and outputting a result of determination. The status determination method includes collecting a plurality of types of status data indicative of current status of the apparatus at a plurality of points in time; calculating a feature value from each of the status data, the feature values corresponding to a change over time in corresponding status data; performing multiple determination operations to output multiple determination results, the multiple determination operations being performed by using any one of determining whether status data corresponding to a single target feature value among the feature values indicates an anomalous status or a normal status by using different discriminant criteria to obtain a determination result, and determining whether status data corresponding to a plurality of target feature values among the feature values indicates an anomalous status or a normal status by using different discriminant criteria to obtain a determination result; majority voting including assigning a weight value to each of the determination results obtained at the performing to obtain weighted determination results, the weight values being determined in advance, performing majority vote to determine which ones of the weighted determination results indicating the anomalous status and the normal status are in majority, and determining whether the apparatus is in an anomalous status or a normal status according to the weighted determination results that is determined to be in majority at the performing majority vote; and displaying the determination results obtained at the performing on a single display area such that the determination results indicating the anomalous status are visually differentiated from the determination results indicating the normal status, wherein the determination results are displayed differently depending on magnitudes of the weight values assigned to the determination results.

According to another aspect of the present invention, there is provided a status determination method of determining a status of an apparatus and outputting a result of determination. The status determination method includes collecting a plurality of types of status data indicative of current status of the apparatus at a plurality of points in time; calculating a feature value from each of the status data, the feature values corresponding to a change over time in corresponding status data; performing multiple determination operations to output multiple determination results, the multiple determination operations being performed by using any one of determining whether status data corresponding to a single target feature value among the feature values indicates an anomalous status or a normal status by using different discriminant criteria to obtain a determination result, and determining whether status data corresponding to a plurality of target feature values among the feature values indicates an anomalous status or a normal status by using different discriminant criteria to obtain a determination result; majority voting including assigning a weight value to each of the determination results obtained at the performing to obtain weighted determination results, the weight values being determined in advance, performing majority vote to determine which ones of the weighted determination results indicating the anomalous status and the normal status are in majority, and determining whether the apparatus is in an anomalous status or a normal status according to the weighted determination results that is determined to be in majority at the performing majority vote; and displaying a status of the apparatus based on an index value that is calculated from a sum of the weighted determination results indicating the anomalous status and a sum of the weighted determination results indicating the normal status.

According to another aspect of the present invention, there is provided an image forming apparatus including a status determining unit that determines a status of the image forming apparatus and outputs a result of determination. The status determining unit includes an information collecting unit that collects a plurality of types of status data indicative of current status of the image forming apparatus at a plurality of points in time; a feature-value calculating unit that calculates a feature value from each of the status data, the feature values corresponding to a change over time in corresponding status data; a multiple-determination unit that performs multiple determination operations to output multiple determination results, the multiple determination operations being performed by using any one of a first determining unit that determines whether status data corresponding to a single target feature value among the feature values indicates an anomalous status or a normal status by using different discriminant criteria to obtain a determination result, and a second determining unit that determines whether status data corresponding to a plurality of target feature values among the feature values indicates an anomalous status or a normal status by using different discriminant criteria to obtain a determination result; a majority-voting unit that assigns a weight value to each of the determination results obtained by the multiple-determination unit to obtain weighted determination results, the weight values being determined in advance, performs majority vote to determine which ones of the weighted determination results indicating the anomalous status and the normal status are in majority, and determines whether the image forming apparatus is in an anomalous status or a normal status according to the weighted determination results that is determined to be in majority; and a displaying unit that displays a status of the image forming apparatus based on an index value that is calculated from a sum of the weighted determination results indicating the anomalous status and a sum of the weighted determination results indicating the normal status.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

A first embodiment of the present invention is a system (hereinafter, "status determination system") that includes a plurality of image forming apparatuses 100 and a managing apparatus 200. The status determination system determines a status of at least one of the image forming apparatuses 100. Each of the image forming apparatuses 100 is an electrophotographic printer that is managed by the managing apparatus 200. The managing apparatus 200 is managed and administered by another party such as a provider (manufacturer) of the image forming apparatus.

An overall configuration of the status determination system will be described.

Figure 1:
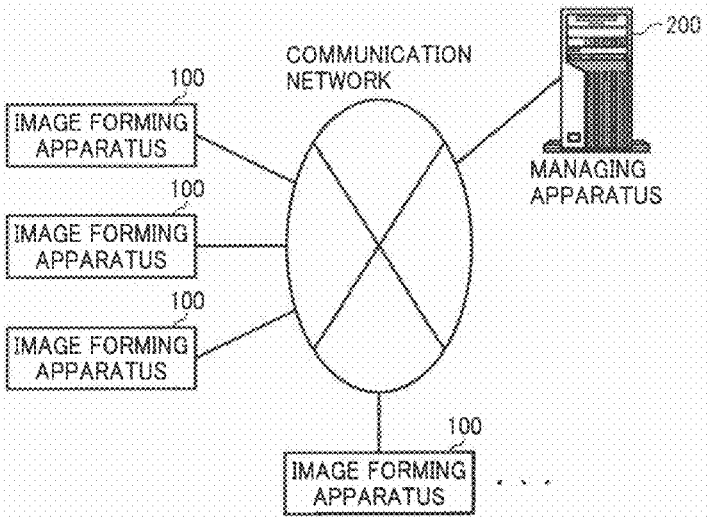
FIG. 1 is a schematic overall configuration diagram of a status determination system according to a first embodiment of the present invention.

FIG. 1 is a schematic overall configuration diagram of the status determination system.

The status determination system includes the image forming apparatuses 100 of the same model that have been delivered to users and installed at the user sites. The image forming apparatuses 100 are connected to the managing apparatus 200 via a communication network such as the Internet for communication. The number of the image forming apparatuses 100 and the managing apparatus 200 included in the status determination system is not limited to those shown in this diagram. For example, the status determination system can alternatively include only one image forming apparatus 100 and one managing apparatus 200, or further alternatively include only one image forming apparatus 100.

Figure 2:
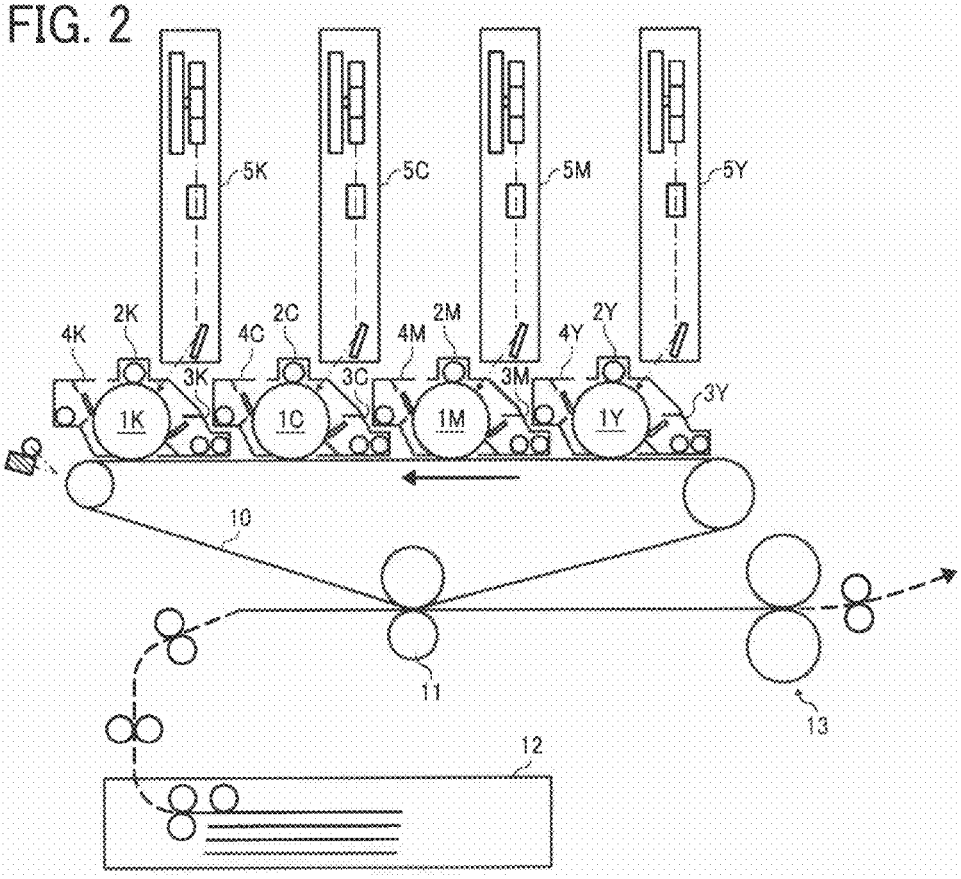
FIG. 2 is a schematic diagram of an image forming apparatus in the status determination system depicted in FIG. 1.

FIG. 2 is a schematic diagram of an internal structure of the image forming apparatus 100. The image forming ,apparatus 100 is, for example, a tandem-type image forming apparatus that includes an intermediate transfer belt 10 and four photosensitive elements 1Y, 1M, 1C, and 1K, in which Y represents yellow, M represents magenta, C represents cyan, and K represents black. The photosensitive elements 1Y, 1M, 1C, and 1K are image carriers. The intermediate transfer belt 10 is an intermediate transfer member. A charging unit 2Y, a developing unit 3Y, a cleaning unit 4Y, and an exposure unit 5Y are arranged around the photosensitive element 1Y. Similarly, each of charging units 2M, 2C, and 2K, developing units 3M, 3C, and 3K, cleaning units 4M, 4C, and 4K, and exposure units 5M, 5C, and 5K are arranged around a corresponding one of the photosensitive elements 1M, 1C, and 1K. Each of the exposure units 5Y, 5M, 5C, and 5K includes a laser diode that serves as a latent-image forming unit. The surfaces of the photosensitive elements 1Y, 1M, 1C, and 1K are uniformly charged to a predetermined potential by the charging units 2Y, 2M, 2C, and 2K. The surfaces are then subjected to the exposure units 5Y, 5M, 5C, and 5K, by which images of corresponding colors are formed on the surfaces. The latent images are developed with toner of corresponding colors in the developing units 3Y, 3M, 3C, and 3K. Hence, toner images are formed on the surfaces of the photosensitive elements 1Y, 1M, 1C, and 1K. These toner images are sequentially transferred onto the intermediate transfer belt 10 and overlapped on one another. Residual toner that remains on the surfaces after the transfer operation is removed by the cleaning units 4Y, 4M, 4C, and 4K.

The toner images transferred onto the intermediate transfer belt 10 are conveyed to a secondary transfer area as the intermediate transfer belt 10 rotates. A pair of secondary transfer rollers 11 is arranged facing each other such that one of the secondary transfer rollers 11 opposes an outer circumferential surface of the intermediate transfer belt 10. A recording medium is picked up from a paper feeding tray 12 and fed to the secondary transfer area timed to arrival of the toner images at the secondary transfer area. The toner images are transferred from the intermediate transfer belt 10 onto the recording medium at the secondary transfer area. The recording medium is then conveyed to pass through a fixing unit 13, in which the toner images on the recording medium are fixed onto the recording medium. The recording medium out of the fixing unit 13 is further delivered to exit the image forming apparatus 100.

Figure 3:
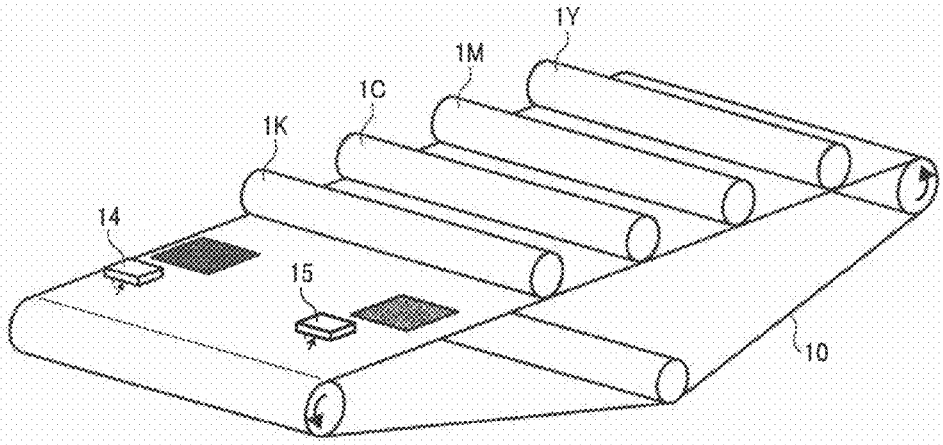
FIG. 3 is a schematic explanatory diagram of arrangement of toner density sensors and an intermediate transfer belt depicted in FIG. 2.
Figure 4:
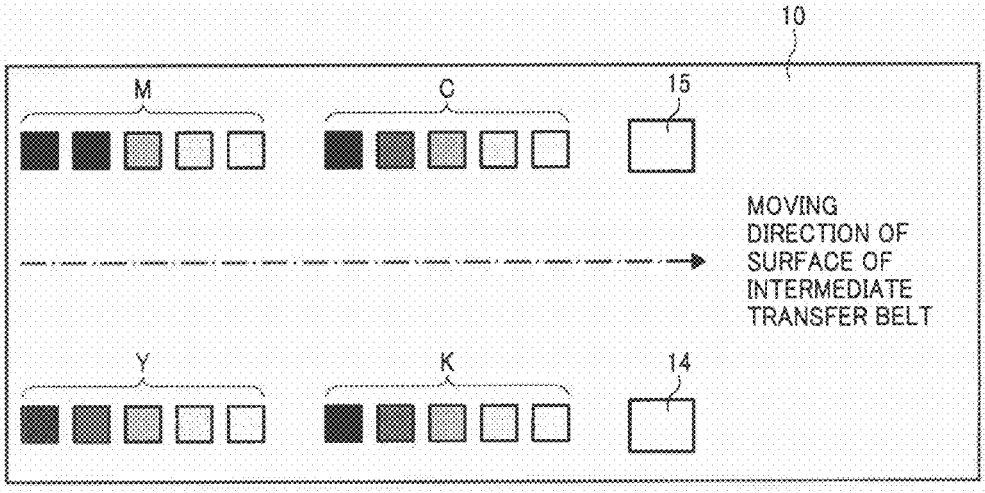
FIG. 4 is a schematic explanatory diagram of the toner density sensors depicted in FIG. 3 as viewed perpendicular to the circumferential surface of the intermediate transfer belt.

As depicted in FIGS. 3 and 4, toner density sensors 14 and 15 are arranged to face the outer circumferential surface of the intermediate transfer belt 10. The toner density sensors 14 and 15 serve as a status-data detecting unit. The toner density sensors 14 and 15 detect densities of toner patterns formed on the intermediate transfer belt 10.

Figure 5A:
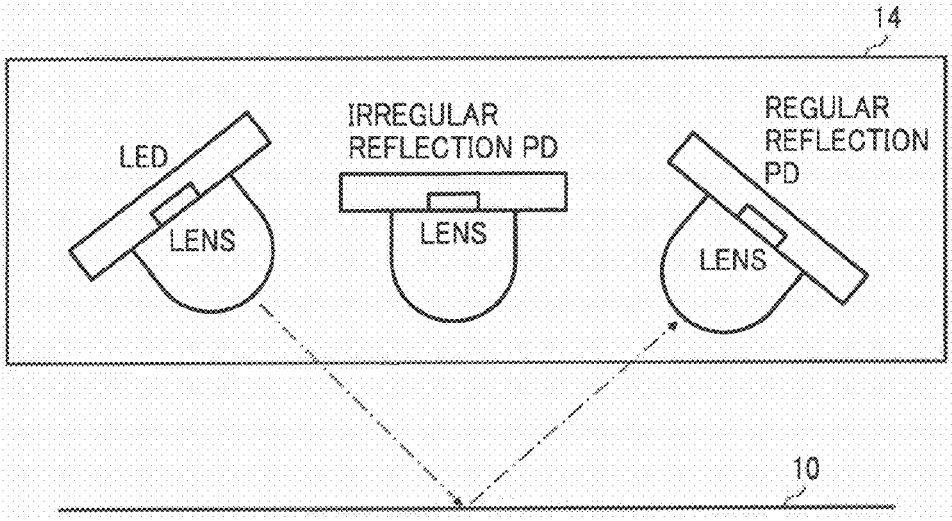
FIGS. 5A and 5B are schematic diagrams for explaining the structure and operation of the toner density sensors depicted in FIG. 3.
Figure 5B:
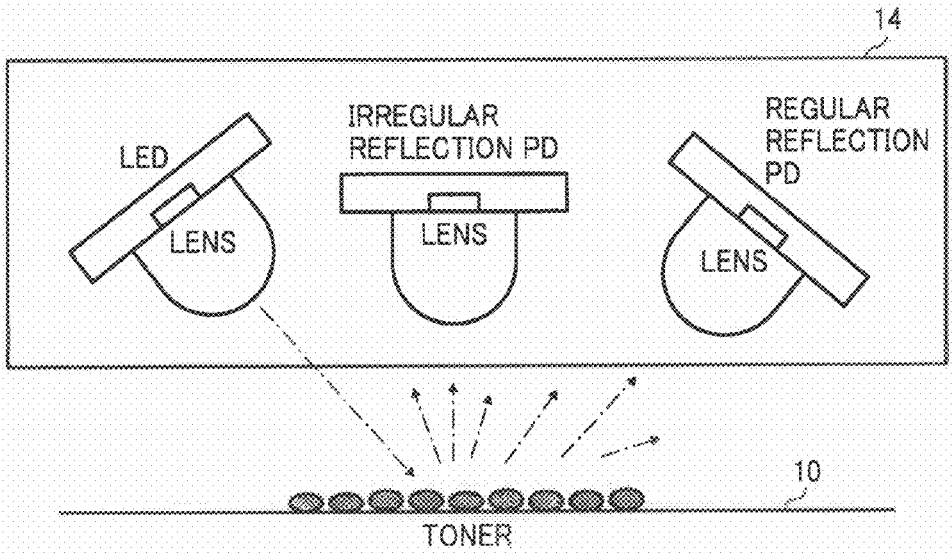

FIGS. 5A and 5B are schematic diagrams for explaining the structure and operation of the toner density sensor 14. The toner density sensor 15 has the same or similar configurations as the toner density sensor 14. As depicted in FIGS. 5A and 5B, the toner density sensor 14 is a reflection-type photosensor that includes one light-emitting diode (LED), which is a photo-emitter, and two photodiode (PD), which are photodetectors. One of the PDs is a regular reflection PD that is positioned so as to receive regularly reflected light. The other one is an irregular reflection PD that is positioned so as to receive irregularly reflected light. Each of the toner density sensor 14 and 15 is arranged to face the outer circumferential surface of the intermediate transfer belt 10 and positioned in a widthwise end portion of the intermediate transfer belt 10. In the image forming apparatus 100, the toner density sensors 14 and 15 are arranged to face the intermediate transfer belt 10; however, arrangement of the toner density sensors 14 and 15 is not limited thereto. The toner density sensors 14 and 15 can be arranged at positions on a passage of the recording medium downstream from the secondary transfer area so that the toner density sensors 14 and 15 detect densities of toner on the recording medium.

The surface of the intermediate transfer belt 10 is made of highly-smooth material to prevent affixation of toner onto the surface. More specifically, the surface is made of polyvinylidene fluoride (PVDF) or polyimide resin and therefore highly glossy. As depicted in FIG. 4, a toner pattern of five-step gradation of each color (Y, M, C, and K) is sequentially formed on the surface of the intermediate transfer belt 10 at predetermined timing. More specifically, a latent image corresponding to the toner pattern of the five-step gradation is formed on each of the photosensitive elements 1Y, 1M, 1C, and 1K by a regular image forming operation. The toner patterns are developed by the developing units 3Y, 3M, 3C, and 3K and transferred onto different positions on the surface of the intermediate transfer belt 10. The toner patterns of the five-step gradation of the four colors are brought to detection positions where the toner patterns oppose the toner density sensors 14 and 15 as the intermediate transfer belt 10 rotates. When the toner patterns pass through the detection positions, the toner density sensors 14 and 15 receive light reflected from the toner patterns and output detection signals indicative of toner densities of the toner patterns.

Figure 6:
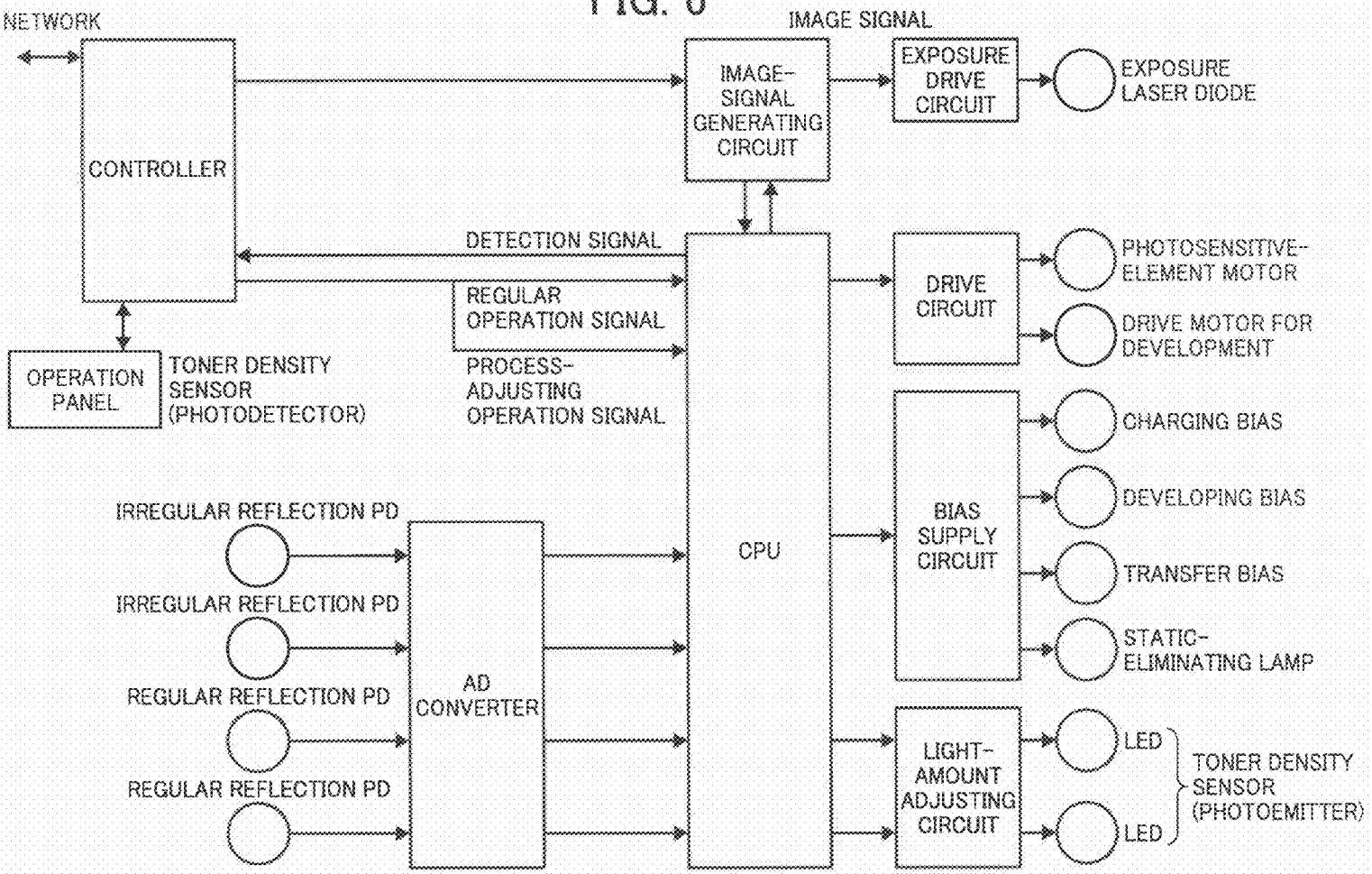
FIG. 6 is a block diagram of a control system involved in process control (process adjusting operation) that is to be performed based on detection signals output from the toner density sensors depicted in FIG. 3.

FIG. 6 is a block diagram of a control system involved in process control (process adjusting operation) that is performed based on the detection signals output from the toner density sensors 14 and 15.

Prior to describing the process control for the process adjusting operation, the process control for regular operation will be described below. When a central processing unit (CPU) of the image forming apparatus 100 receives a regular operation signal from an upper-level device, or a what-is-called controller, of the image forming apparatus 100, the CPU energizes an image-signal generating circuit. The image-signal generating circuit causes, by way of an exposure drive circuit, exposure laser diodes of the exposure units 5Y, 5M, 5C, and 5K to illuminate on and off according to image signals. The CPU also actuates a photosensitive-element motor and a drive motor for development by way of a drive circuit. The CPU also supplies various bias voltages, such as charging bias, developing bias, and transfer bias, by way of a bias supply circuit in appropriate sequence to perform an image forming operation. A static eliminating lamp is also energized by way of the bias supply circuit. Meanwhile, in an electrophotographic image forming apparatus, such as the image forming apparatus 100, image density can fluctuate due to degradation over time or environmental variation. To this end, an electrophotographic image forming apparatus generally includes a toner density sensor or a like process control sensor and performs process adjusting operation to stabilize image density.

Figure 7:
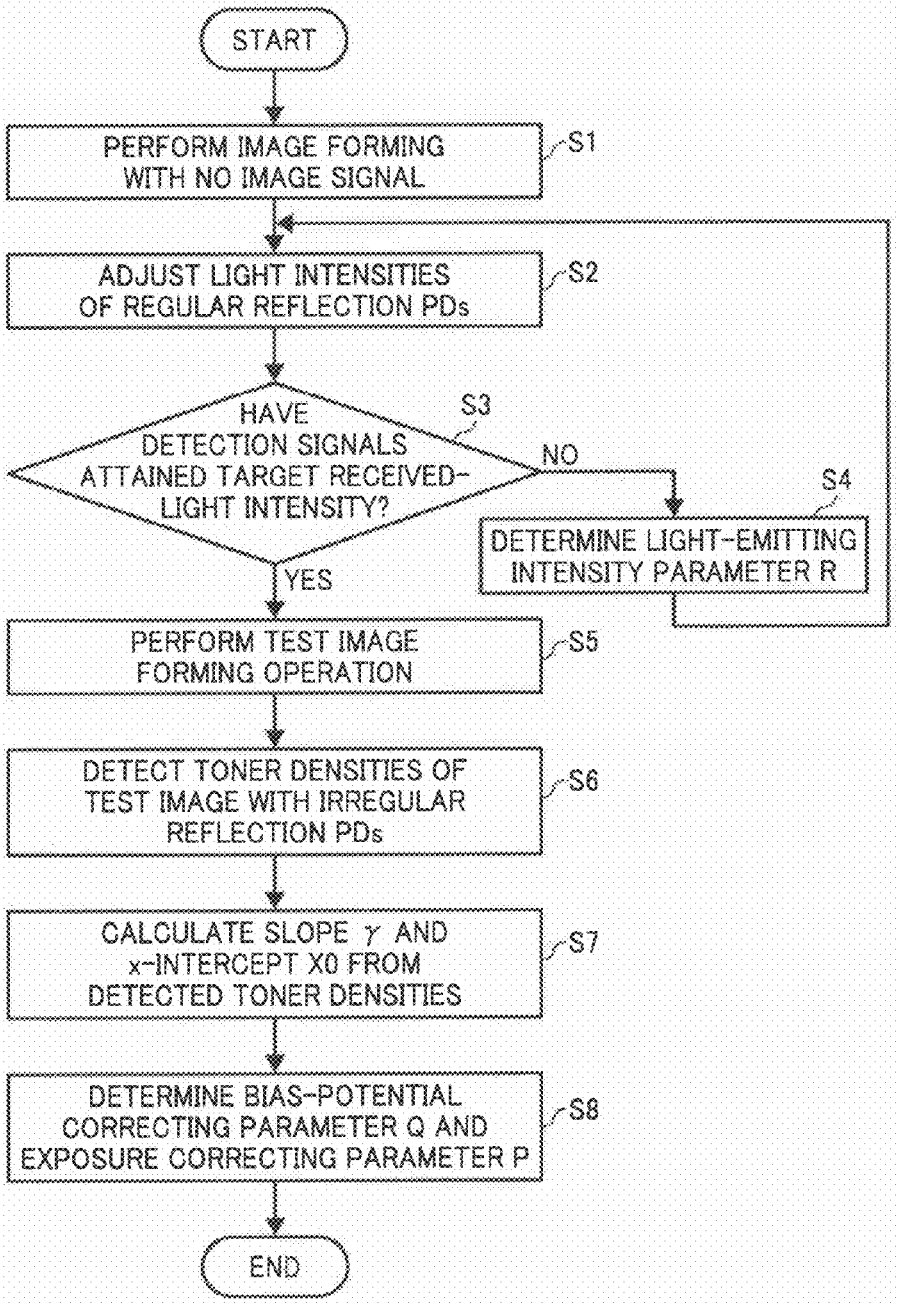
FIG. 7 is a flowchart of a main procedure of the process control depicted in FIG. 6.

The process control for the process adjusting operation will be described below. FIG. 7 is a flowchart of a main procedure of the process control (process adjusting operation).

When the CPU receives a process-adjusting operation signal from the controller, when the CPU receives a regular operation signal from the controller, or when the CPU determines that image forming operation according to a regular operation signal has completed, the process adjusting operation is started. Image forming for calibration of the toner density sensors 14 and 15 is performed in a state in which no image signal is generated in the image-signal generating circuit (Step S1). Because no image signal is generated in the image-signal generating circuit, ideally no toner is present on the surfaces of the photosensitive elements 1Y, 1M, 1C, and 1K and the intermediate transfer belt 10. Detection signals output from the toner density sensors 14 and 15 are transmitted to the CPU via an analog-digital (AD) converter. The CPU causes a light-amount adjusting circuit to adjust the light intensities of the LEDs of the toner density sensors 14 and 15 so that the detection signals attain predetermined target received-light intensity (Step S2). Whether the detection signals output from the regular reflection PDs have attained the target received-light intensity is determined (Step S3). If the detection signals have failed to attain the target received-light intensity (No at Step S3), a light-emitting intensity parameter R is determined (Step S4), and then the process control returns to Step S2. In this manner, the toner density sensors 14 and 15 are adjusted so that they can surely detect toner densities without being affected by variations in performance among the photodetectors and the photo-emitters of the toner density sensors 14 and 15, degradation over time of the same, and degradation over time of the surfaces of the photosensitive elements 1Y, 1M, 1C, and 1K.

Figure 8A:
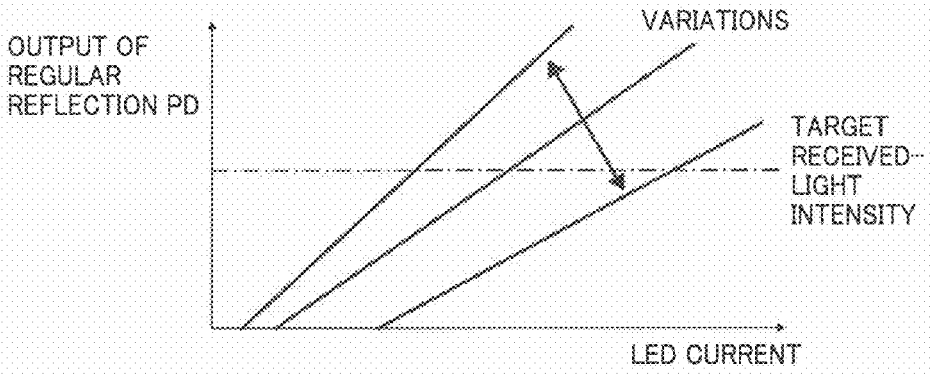
FIG. 8A is a graph of relationship between outputs of regular reflection PDs and LED current values for explaining how the PDs are controlled during calibration.
Figure 8B:
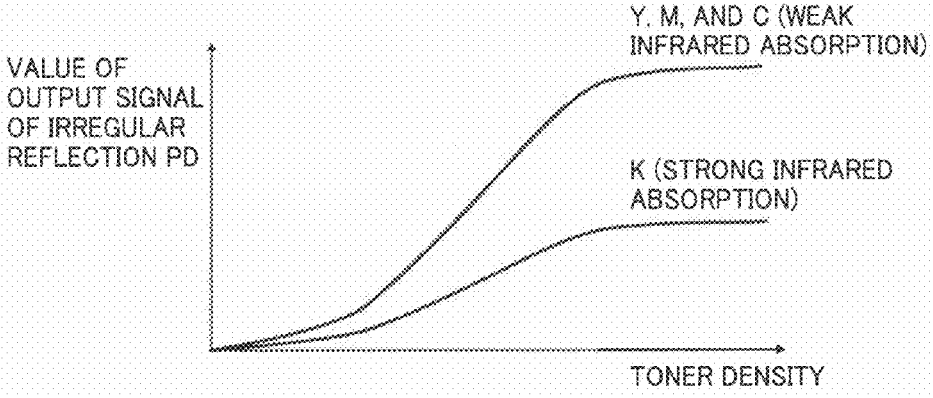
FIG. 8B is a graph of relationships between outputs of irregular reflection PDs and toner densities.

Subsequently, image forming operation (hereinafter, "toner-pattern forming operation") is performed to automatically form predetermined toner patterns (test image) such as those depicted in FIG. 4 (Step S5). The toner density sensors 14 and 15 detect toner densities of the toner patterns formed on the surface of the intermediate transfer belt 10 during the course of the toner-pattern forming operation. The toner patterns are formed under a specific image forming condition defined by predetermined values of the charging bias, the developing bias, and the like. Signals output from the irregular reflection PDs of the toner density sensors 14 and 15 are used as detection signals of the toner densities of the toner patterns (Step S6). A relationship between values of the signals output from the irregular reflection PDs and the toner densities is depicted in FIG. 8B. Hence, toner densities of the toner patterns can be obtained from the values of the output signals of the irregular reflection PDs. Meanwhile, each toner contains coloring agent of the corresponding one of the four colors. Accordingly, it is preferable that the photo-emitters of the toner density sensors 14 and 15 emit near-infrared or infrared light whose wavelength is approximately 840 nanometers to avoid influences exerted from the coloring agents. However, because black toner generally contains carbon black that is relatively less expensive but highly absorptive of light even in the infrared region, the toner density sensors 14 and 15 are less sensitive to toner density of the black toner than to toner densities of the other colors as depicted in FIG. 8B.

Figure 9:
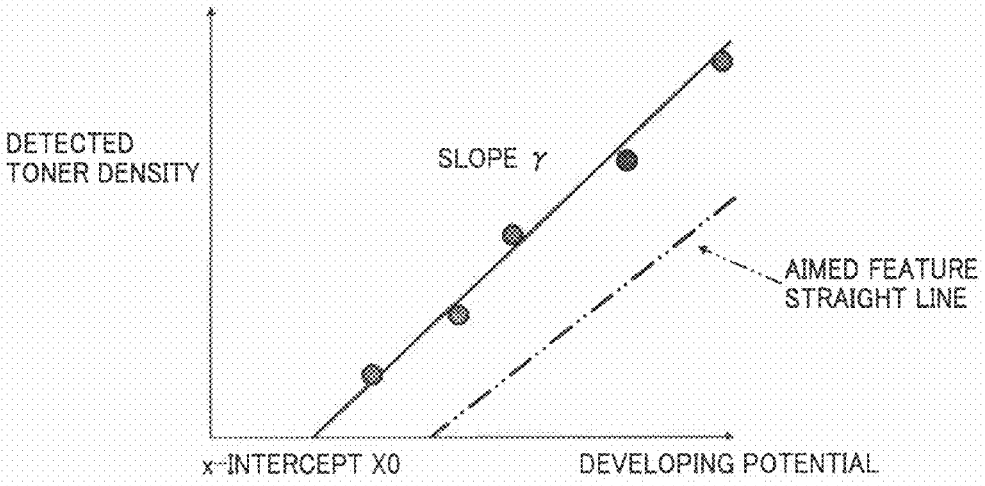
FIG. 9 is a graph for explaining relationship between detected toner densities of toner patterns and developing potentials.

FIG. 9 is a graph for explaining relationship between detected toner densities of toner patterns and developing potentials.

In the image forming apparatus 100, toner densities of each of the five-step gradations of the toner pattern are detected on a color-by-color basis. A linear approximation of the toner densities that are detected at five points is performed for each color to obtain a straight line representing a relationship between developing potentials and amounts of toner sticking to the formed image (hereinafter, "feature straight line") (Step S7). When the slope γ and the x-intercept X0 of the feature straight line deviate from those of an aimed feature straight line, correction is performed to make densities of an image uniform. More specifically, the slope γ is corrected primarily by multiplying exposure-light-intensity signals by an exposure-light-intensity correcting parameter (hereinafter, "exposure correcting parameter") P (Step S8). The x-intercept X0 is corrected by primarily multiplying the developing bias by a bias-potential correcting parameter Q. The x-intercept X0 indicates the potential at which developing is to be started. Note that similar effect to that obtained by this approach can be obtained by correcting other values pertaining to this process control in place of correcting the exposure light intensity and the developing bias. Examples of the other values include the charging bias and the transfer bias.

The process control is performed to compensate fluctuations in an amount of charge of toner due to variation in temperature and/or humidity and fluctuations in sensitivity of the photosensitive elements in a normal status. However, status data, such as output signals of the toner density sensors 14 and 15, for use in the process control fluctuates in some cases when a specific type of failure or a prefailure status occurs.

A specific example of a change in the status data resulting from occurrence of a failure or a prefailure status will be described below. The cleaning units 4Y, 4M, 4C, and 4K collect residual toner on the photosensitive elements so that next charging and exposure operation are performed normally. The cleaning units 4Y, 4M, 4C, and 4K generally include urethane-rubber cleaning blades to remove the residual toner by bringing the cleaning blades into sliding contact with the surfaces of the photosensitive elements. If, with this blade type cleaning unit, some toner is caught in a gap between the cleaning blade and the surface of the photosensitive element, the toner can remain on the surface of the photosensitive element without being collected by the cleaning blade. The remaining toner is generally electrostatically collected by the developing unit while the remaining toner passes through the charging unit and the exposure unit. However, if the electrical charge of the remaining toner is removed or the shape of the remaining toner is changed by friction exerted by the cleaning blade, it is possible that the remaining toner still remains on the surface of the photosensitive element without being collected by the developing unit. The still-remaining toner is electrostatically transferred onto the surface of the intermediate transfer belt 10 and eventually transferred onto a recording medium. Positions to which the still-remaining toner is transferred can be in a non-image portion on the surface of the intermediate transfer belt 10. In this case, the still-remaining toner can stick to a non-image portion of a recording medium and form stray toner dots on a non-image portion of a printout. Hereinafter, the status of the image forming apparatus 100 in which the image forming apparatus 100 outputs such a printout is referred to as "dirty-printing status". Examples of printouts of the image forming apparatus in the dirty-printing status are depicted in FIGS. 10A and 10B.

Figure 10A:
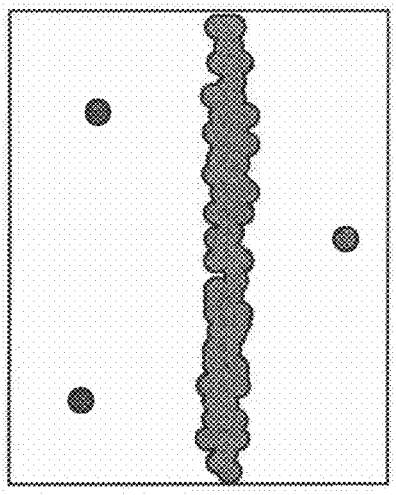
FIG. 10A is a schematic explanatory diagram of a normal printout output from the image forming apparatus in a normal status.

Even when stray toner dots appear on the image, if the amount of toner of the stray toner dots is minute as depicted in FIG. 10A, an impact of the stray dots on image quality is not large. Hence, the image forming apparatus 100 can be classified into an allowable range (normal status). However, if a cleaning blade is worn by long-time usage and degraded in toner-removing performance, an amount of remaining toner uncollected by the cleaning blade increases in an accelerated manner. When the cleaning blade is further continued to be used, it is possible that a large amount of toner having been blocked by a leading-end portion of the cleaning blade in an axial direction of the photosensitive elements surmounts the cleaning blade all at once. The toner moves across a position where the toner is to be collected by the cleaning blade without being collected. In such a case, the toner deposited on the charging unit reduces charging capacity of the charging unit while the large amount of toner prevents the exposure units from forming desired latent images on the surfaces of the photosensitive elements. As a result, streaks extending in the moving direction (hereinafter, "first direction") of the intermediate transfer belt 10 eventually appear on a printout at a position corresponding to the position where the toner has surmounted the cleaning blade, bringing the image forming apparatus 100 to a failure status where the image forming apparatus 100 requires immediate repair.

Figure 10B:
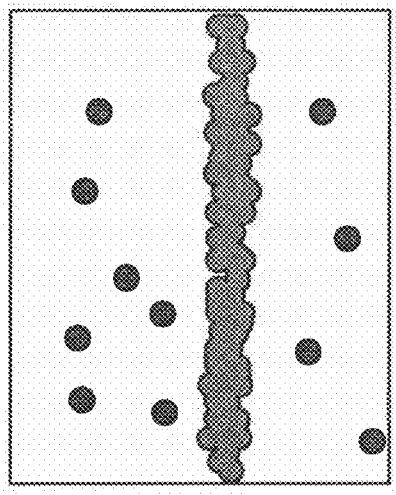
FIG. 10B is a schematic explanatory diagram of a moderately-dirty printout output from the image forming apparatus in a moderately-dirty-printing status.

The inventors of the present invention have confirmed that, a short while before the image forming apparatus 100 enters the failure status, an amount of stray dots on a printout increases generally uniformly across an entire image forming area that is subjected to image forming operation as depicted in FIG. 10B. However, because such an increase in the amount of the stray dots across the entire image forming area is not visually apparent, this type of dirty printing is rarely noticed by a user. Hereinafter, this status is taken as a prefailure status, which is a sign of a failure of the cleaning blade, and referred to as "moderately-dirty printing status".

Figure 11A:
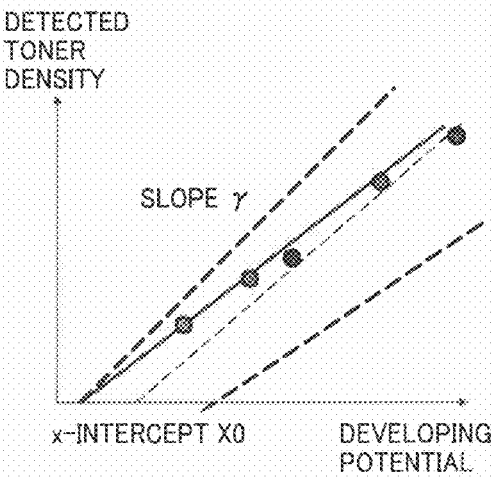
FIG. 11A is a graph of a feature straight line of the image forming apparatus in the moderately-dirty printing status.
Figure 11B:
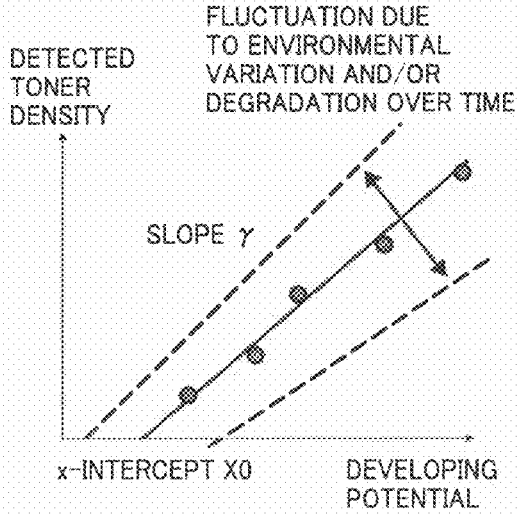
FIG. 11B is a graph of a feature straight line of the image forming apparatus undergone a change due to environmental variation and/or degradation over time.

In such a moderately-dirty printing status, results of detection performed by the toner density sensors 14 and 15 are changed from those in the normal status as depicted in FIG. 11A. The lower the toner density of the five-step-gradation toner patterns is, the more the detected toner density is increased. Put another way, the slope γ and the x-intercept X0 of the feature straight line of the moderately-dirty printing status are likely to be slightly smaller than those of the normal status. However, difference between such a change resulting from the moderately-dirty printing status in the feature straight line and a change resulting from environmental variation and/or degradation over time is not large. This makes it extremely difficult to determine whether the image forming apparatus 100 is in the moderately-dirty printing status by using an amount of change in the slope γ or the x-intercept X0 of a single color toner, or an amount of change in the correcting parameters P and Q that are determined by the slope γ and the x-intercept X0. In other words, it is difficult to notify a user of a sign of a failure of the cleaning blade with high accuracy. Hence, conventional notification of a prefailure status has been made only when an image forming apparatus apparently deviates from a normal status. This has conventionally made it difficult in many cases to prepare for occurrence of a failure of a cleaning blade before the failure actually occurs.

Figure 12:
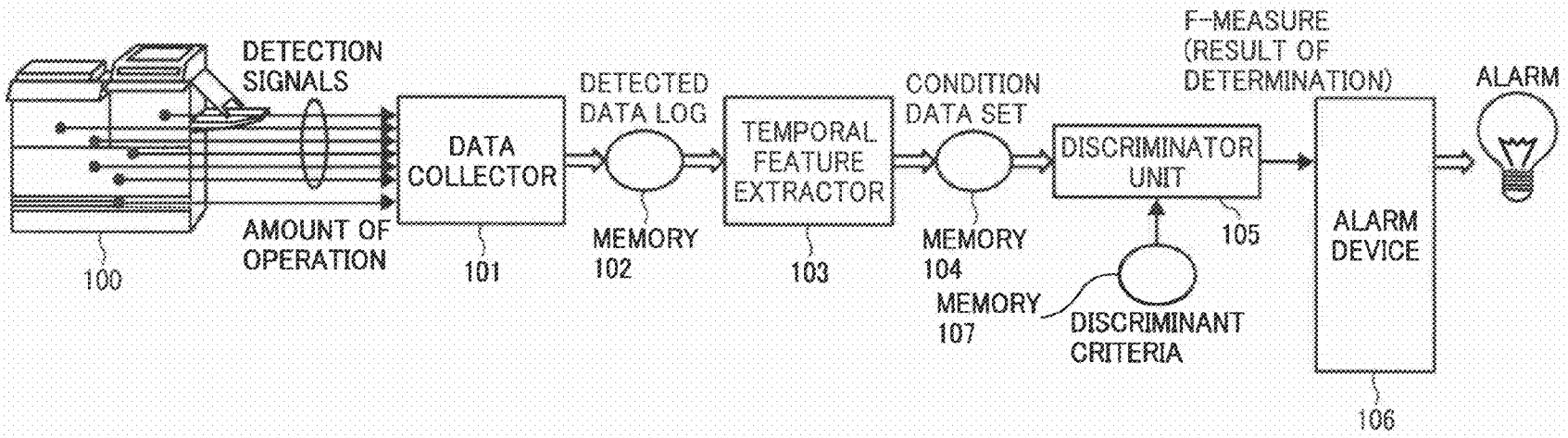
FIG. 12 is a block diagram for explaining operations to be performed to notify a user of a prefailure status of a black cleaning blade.

FIG. 12 is a block diagram for explaining operations to be performed to notify a user of a prefailure status of a cleaning blade for black toner (hereinafter, "black cleaning blade") of the photosensitive element 1K.

Figure 13:
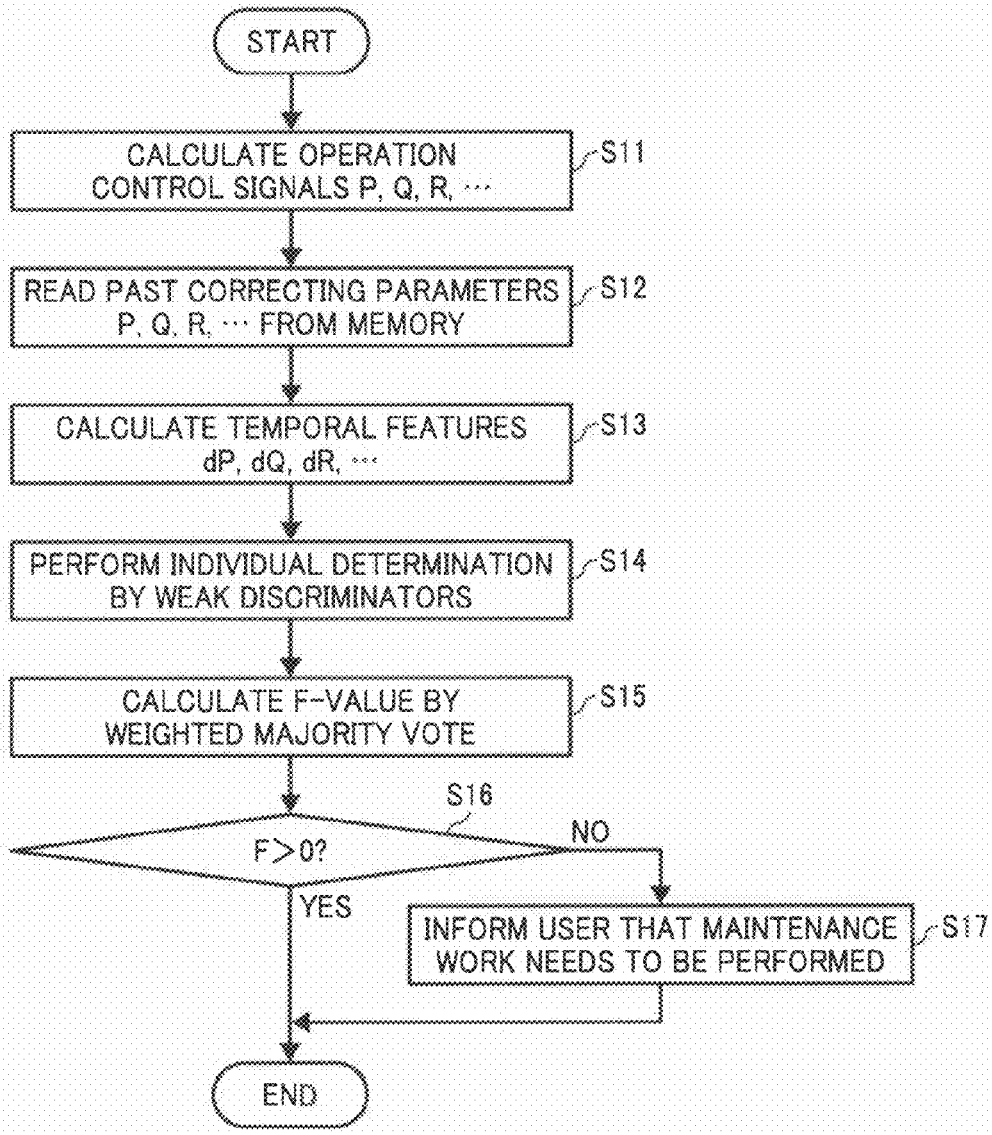
FIG. 13 is a flowchart of process control for determining whether the black cleaning blade is in a prefailure status.

FIG. 13 is a flowchart of process control for determining whether the black cleaning blade is in a prefailure status.

In the first embodiment, the correcting parameters P and Q that are calculated from the detection signals of the toner density sensors 14 and 15 of the image forming apparatus 100 are used as the detection signals, or the status data. Whether the black cleaning blade is in a prefailure status is determined by using the correcting parameters P and Q. More specifically, the process adjusting operation is performed to calculate the correcting parameters P and Q of each color (Step S11). A data collector 101 adds the correcting parameters P and Q to a detected data log and stores the detected data log in a memory 102. In the first embodiment, the data collector 101 is implemented by the CPU accompanied by a memory (not shown); however, the data collector 101 can be implemented by the controller (upper level device) that controls the image forming apparatus 100. Further alternatively, a dedicated device that is provided independently from the image forming apparatus 100 can be used as the data collector 101.

Figure 14:
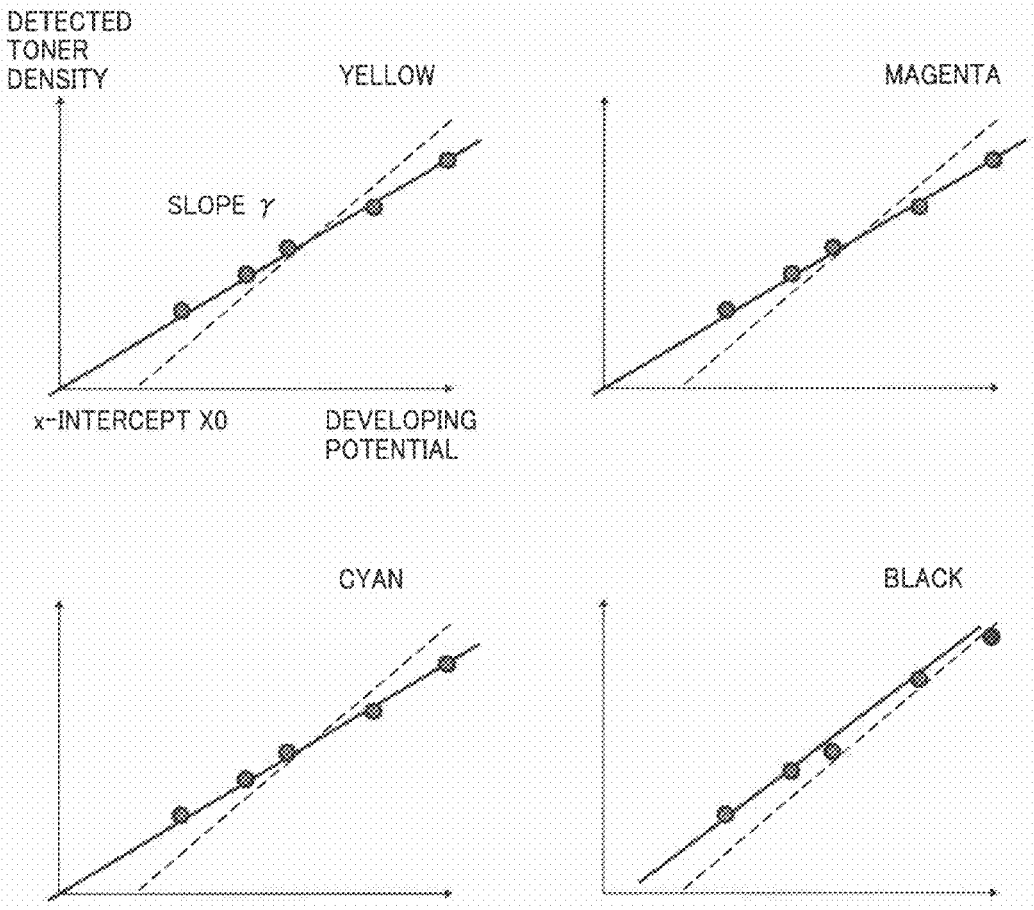
FIG. 14 is a set of graphs depicting feature straight lines of different colors obtained by performing a process adjusting operation.
Figure 15:
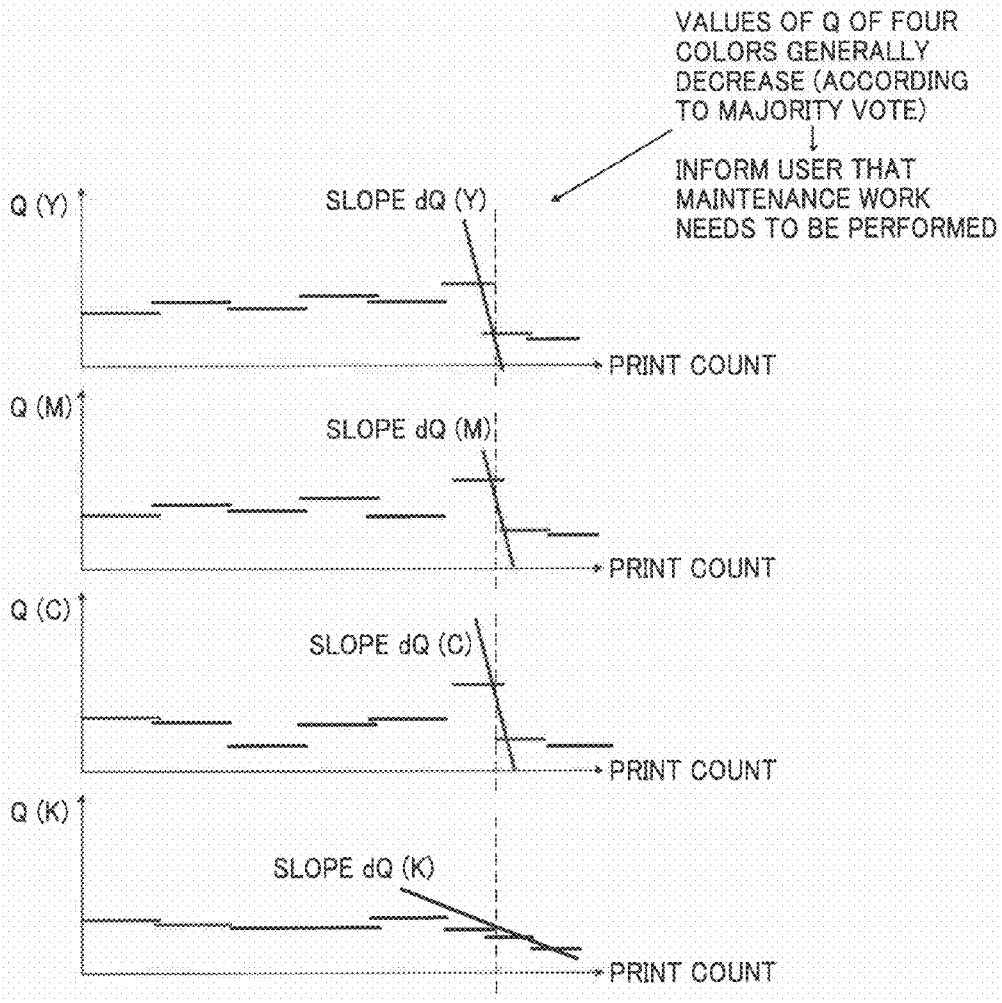
FIG. 15 is a graph depicting changes over time in bias-potential correcting parameters Q.

Subsequently, a temporal feature extractor 103 performs mathematical or statistical calculation to determine whether the present detection signals have changed specifically as compared with past detection signals. The temporal feature extractor 103 then stores the result of the calculation as condition data set of the current point in time in a memory 104 (Steps S12 and S13). The condition data set is then transmitted from the memory 104 to a discriminator unit 105. More specifically, for example, assume that such feature straight lines as depicted in FIG. 14 are obtained by performing the process adjusting operation. In this case, the log of the correcting parameters Q is updated as depicted in FIG. 15. Meanwhile, the correcting parameters P, Q, and R are operation control signals. A coarse differential dQ is calculated by dividing a difference between a value of the current Q and that of an immediately preceding Q by an operating duration therebetween or by an amount of operation performed in the duration. The amount of operation is, for example, an operating period of time or a print count. This coarse differential dQ is stored in the memory 104 as one data piece of the condition data set.

Meanwhile, because deterioration of an image forming apparatus over time generally primarily depends on the amount of operation, the coarse differentials are preferably calculated by using amounts of operation rather than operating duration. The amounts of operation are generally under internal control of the CPU. Hence, the data collector 101 preferably stores therein the amounts of operation in addition to the detection signals. Accumulated value of the operating duration or real-time duration can be used as the amount of operation.

The temporal feature value to be extracted by the temporal feature extractor 103 is not limited to the coarse differential dQ. The temporal feature extractor 103 can extract, for example, a regression value of a change in the detection signals, or a standard deviation, a maximum value, or an average value of a plurality of recently-obtained data pieces in place of the coarse differential dQ. A large number of methods for extracting feature values of such time-series signals have been proposed. Any of those methods can be employed. For example, a method based on an auto regressive integrated moving average (ARIMA) model can be employed. From a general point of view, a sign of a failure can be obtained by detecting various types of specific, unstable changes in detection signals (status data) that would not occur in a normal status. Accordingly, an appropriate one of temporal feature extraction methods can be selected from this point of view.

The condition data set can further include a feature value calculated without a temporal factor. The feature value is, for example, a value of a detection signal of the present point in time or data related operation, such as an operating duration or an amount of operation. The log to be stored in the memory 102 can additionally include a signal that indicates whether a repair for a failure has been performed. In this case, it is possible to avoid an erroneous determination that a change that transiently occurs in the condition data set immediately after the repair indicates a prefailure status.

The discriminator unit 105 is implemented by the CPU that executes a predetermined discrimination computer program. The discriminator unit 105 determines whether the status data indicates a normal status or a prefailure status. It is preferable to implement at least one of the temporal feature extractor 103 and the discriminator unit 105 by a predetermined computer program rather than by hardware in view of cost and development period. The discriminator unit 105 of the first embodiment includes a plurality of weak discriminators. The weak discriminators individually correspond to each data piece of the condition data set (e.g., a feature value such as the coarse differential dQ), and determine whether the corresponding data piece indicates a normal status or a prefailure status (Step S14). The discriminator unit 105 performs weighted majority vote of results of the determination by using the weak discriminators (Step S15), and outputs a final determination result (F-value). When the F-value indicates the prefailure status (Step S16), an alarm device 106 informs a user of this effect (Step S17). A notification of this effect can be transmitted to an operator of the managing apparatus 200 by way of the communication network.

The discriminator unit 105 of the first embodiment advantageously uses, as the weak discriminators, what-are-called decision stumps that determine only whether a given value is greater or smaller than a threshold value. Employment of the decision stumps is advantageous in permitting the CPU to perform calculation at high speed. Furthermore, because a result of determination performed by weighted majority vote is sufficiently accurate, a prefailure status can be predicted accurately without great additional cost.

How to perform the status determination by using the decision stumps as the weak discriminators will be described below.

A decision stump is provided for each of n temporal feature values C1 to Cn that are calculated for the detection signals P, Q, and R. The F-value, or a result of weighted majority vote, is calculated by using Equation (1):

$$F = \sum_{f=1}^{n} (\alpha 1 \times \mathrm{OUT}) \tag{1}$$

where αi is a weight coefficient assigned to each of the weak discriminators, and OUTi is a result of determination by using the weak discriminator.

When (Ci-bi) is equal to or greater than zero, OUTi is obtained by using Equation (2), while when (Ci-bi) is smaller than zero, OUTi is obtained by using Equation (3):

$$\mathrm{OUT}i=(sgni(Ci-bi)) \tag{2}$$

$$\mathrm{OUT}i=-(sgni(Ci-bi)) \tag{3}$$

where bi is a threshold value of each of the feature values, and sgni is a coefficient related to a sign (hereinafter, "sign-related coefficient").

In the first embodiment, when the thus-calculated F-value is smaller than zero (No at Step S16), the image forming apparatus 100 is determined to be in the prefailure status.

The discriminant criteria, such as the weight coefficient αi, the sign-related coefficient sgni, and the threshold value bi, are learned as detection signals collected during test operation and/or actual image forming operation of the image forming apparatus 100. The discriminator unit 105 performs determination by referring to the discriminant criteria having been stored in a memory 107 in advance. The discriminant criteria αi, sgni, and bi can be determined by using a what-is-called boosting method, which is one of supervised learning algorithms. The boosting method is described in, for example, S. Eguchi, "Tokei-teki pattern shikibetsu no jouhou kika", Suuri-Kagaku (Mathematical Sciences) vol. 489, March, 2004 (in Japanese). More specifically, the discriminant criteria are determined based on detected data log (hereinafter, "normal log data") about a status having been confirmed to be a normal status and detected data log (hereinafter, "prefailure log data") about a status having been confirmed to be a prefailure status. The prefailure log data is obtained, for example, as follows. Data collected during a durability test of the image forming apparatus 100 or the like is logged as a detected data log. When a failure occurs during the durability test or the like, a prefailure period preceding to occurrence of the failure is estimated. A portion of data of the detected data log corresponding the prefailure period is used as the prefailure log data.

The inventors actually performed an experiment for validation by using more than ten image forming apparatuses (hereinafter, "test apparatuses") for three months to collect failure example cases while keeping a detected data log. The experiment will be described below.

Figure 16:
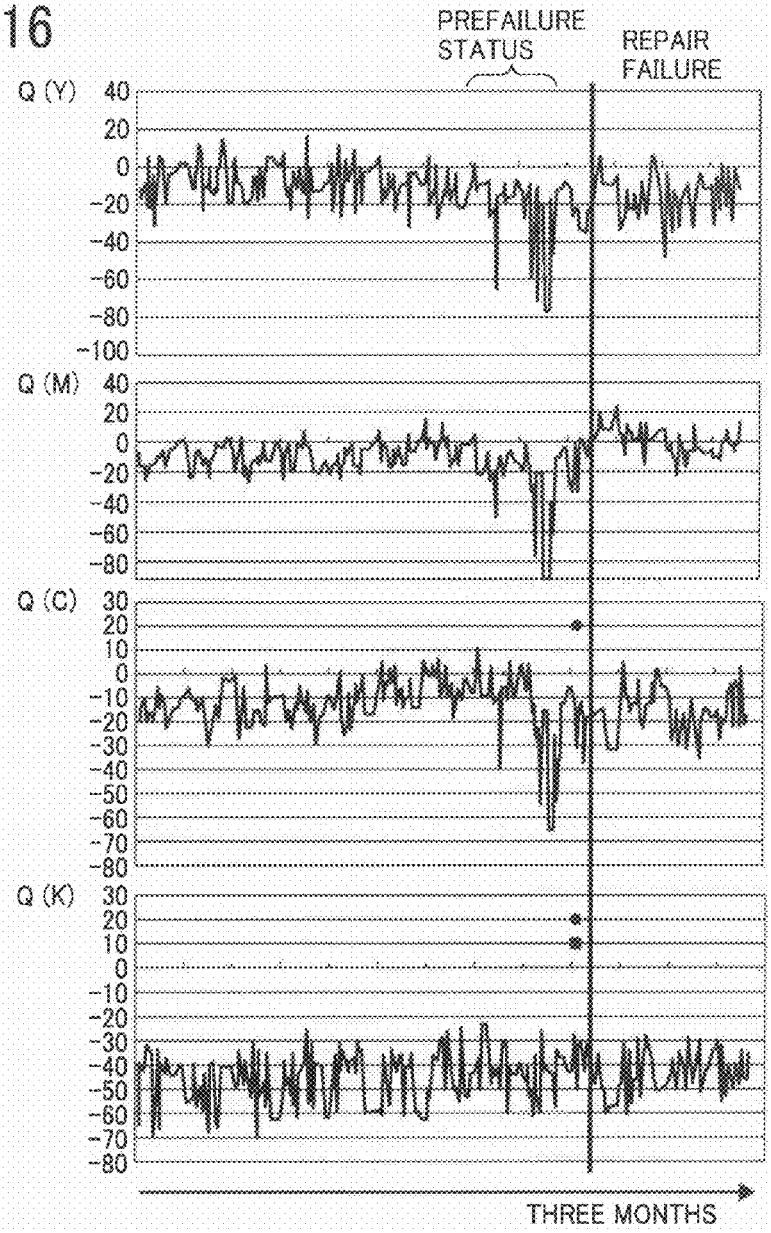
FIG. 16 is a graph depicting changes over time in bias-potential correcting parameters Q of one test apparatus in which black cleaning failure has occurred.

FIG. 16 is a graph that represents changes over time in the correcting parameters Q of the four colors in one test apparatus in which a black cleaning failure occurred. More specifically, the test apparatus formed a defective image that had black toner streaks extending in the first direction thereon. Each of the parameters Q was a value corresponding to the x-intercepts X0 although their positive/negative signs were opposite from each other. Although the inventors collected a number of status data pieces other than the correcting parameters Q during the experiment, because changes in the correcting parameters Q were most noticeable, only the bias-potential correcting parameters Q are described below. Referring to FIG. 16, the correcting parameters Q of Y, M, and C fluctuated sharply just before occurrence of the black cleaning failure. Temporal feature values of Y, M, and C corresponding to this sharp fluctuation were extracted, which were then subjected to calculation of a condition data set. Thereafter, a prefailure period was visually estimated. A portion of the condition data set corresponding to the prefailure period was labeled with −1 (prefailure period) while the remaining portion of the condition data set was labeled with +1 (normal period). By performing 100 times of iterative learning according to a boosting method, the discriminant criteria αi, sgni, and bi corresponding to the correcting parameters Q were determined.

Figure 17:
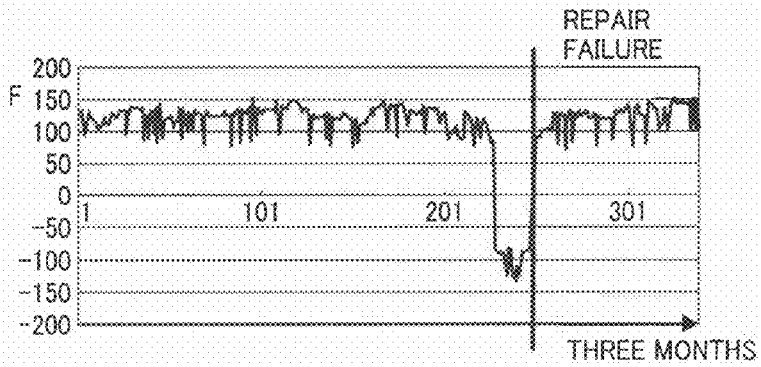
FIG. 17 is a graph of F-values calculated from data collected for iterative learning.

FIG. 17 is a graph of F-values calculated from data collected during the iterative learning.

This graph indicates that because the labeled, supervised data pieces were appropriately learned, the discriminator unit 105 that outputs positive F-values for a normal period but outputs negative F-values only for a prefailure period was successfully generated.

Figure 18:
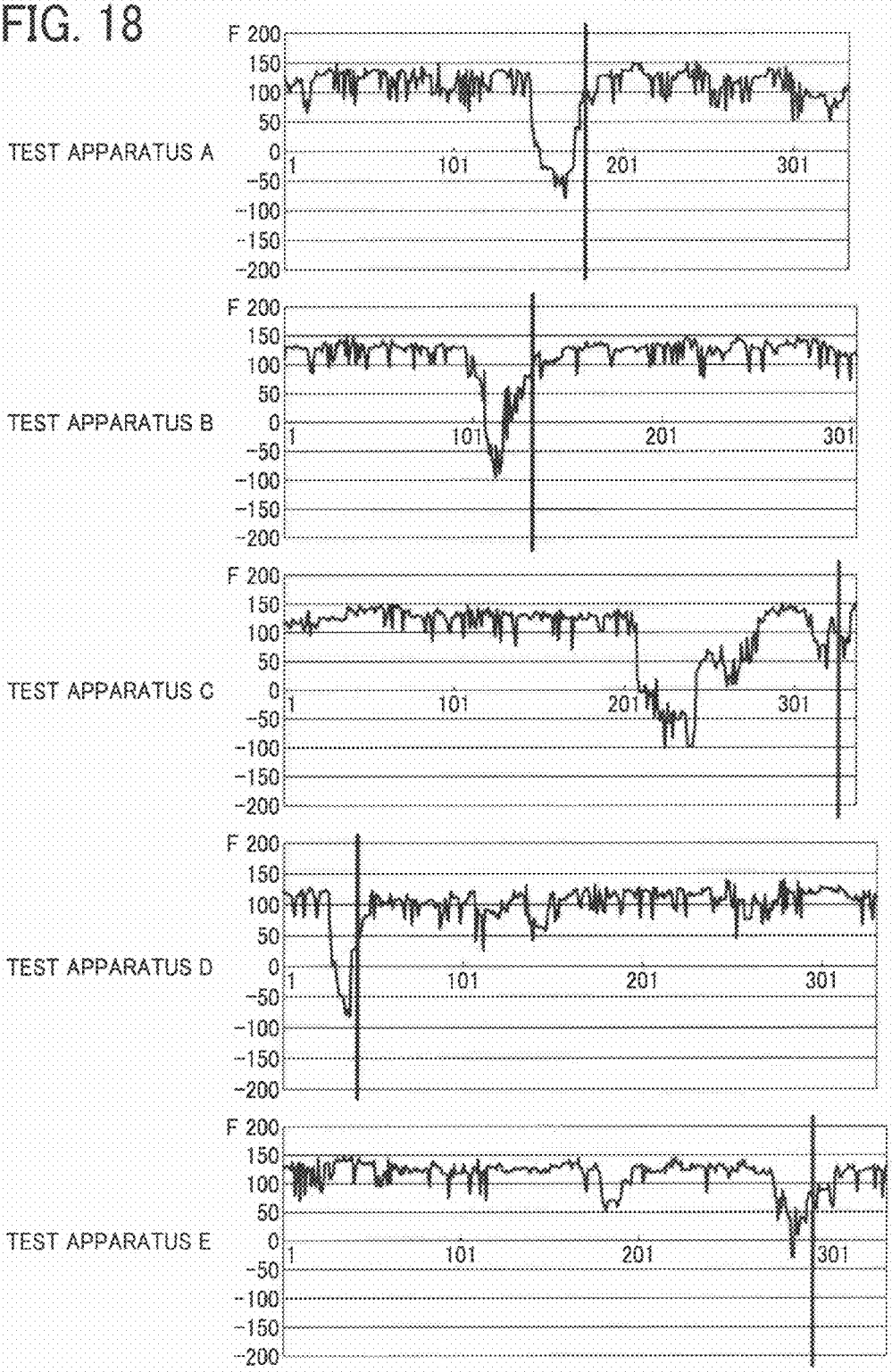
FIG. 18 is a graph depicting the result of validation that was performed by applying discriminant criteria generated based on data of FIG. 16 to other five test apparatuses.

Subsequently, follow-up validation was performed to check whether the thus-generated discriminator unit 105 was capable of outputting an appropriate result for detected data log that was not used in the iterative learning. This validation was performed by using condition data sets that were calculated by using detected data logs of data collected from five test apparatuses A to E in which black cleaning failure had occurred. The result of this validation is depicted in FIG. 18.

The discriminator unit 105 output F-values by referring to the discriminant criteria αi, sgni, and bi. As intended, the F-values were negative during prefailure periods of the test apparatuses A to E preceding to occurrence of the same type of the failure (black cleaning failure) as that of the failure for which the discriminator unit 105 was generated. Hence, it was confirmed that when an F-value falls to negative or zero, the apparatus can be determined to be in a prefailure status with regard to a black cleaning failure. Accordingly, by continuously collecting the correcting parameters Q of the image forming apparatus 100 after it has started on-site operation and by causing the discriminator unit 105 to perform determination, it is possible to replace or repair the black image forming unit before black streaks extending in the first direction appear on an image formed by the image forming apparatus 100. This advantageously prevents waste of resources resulting from forming an image again in place of a defective image with black streaks thereon. Furthermore, downtime of the image forming apparatus 100 can be reduced by performing the repair or the replacement during a period where the image forming apparatus 100 is not used.

Figure 19:
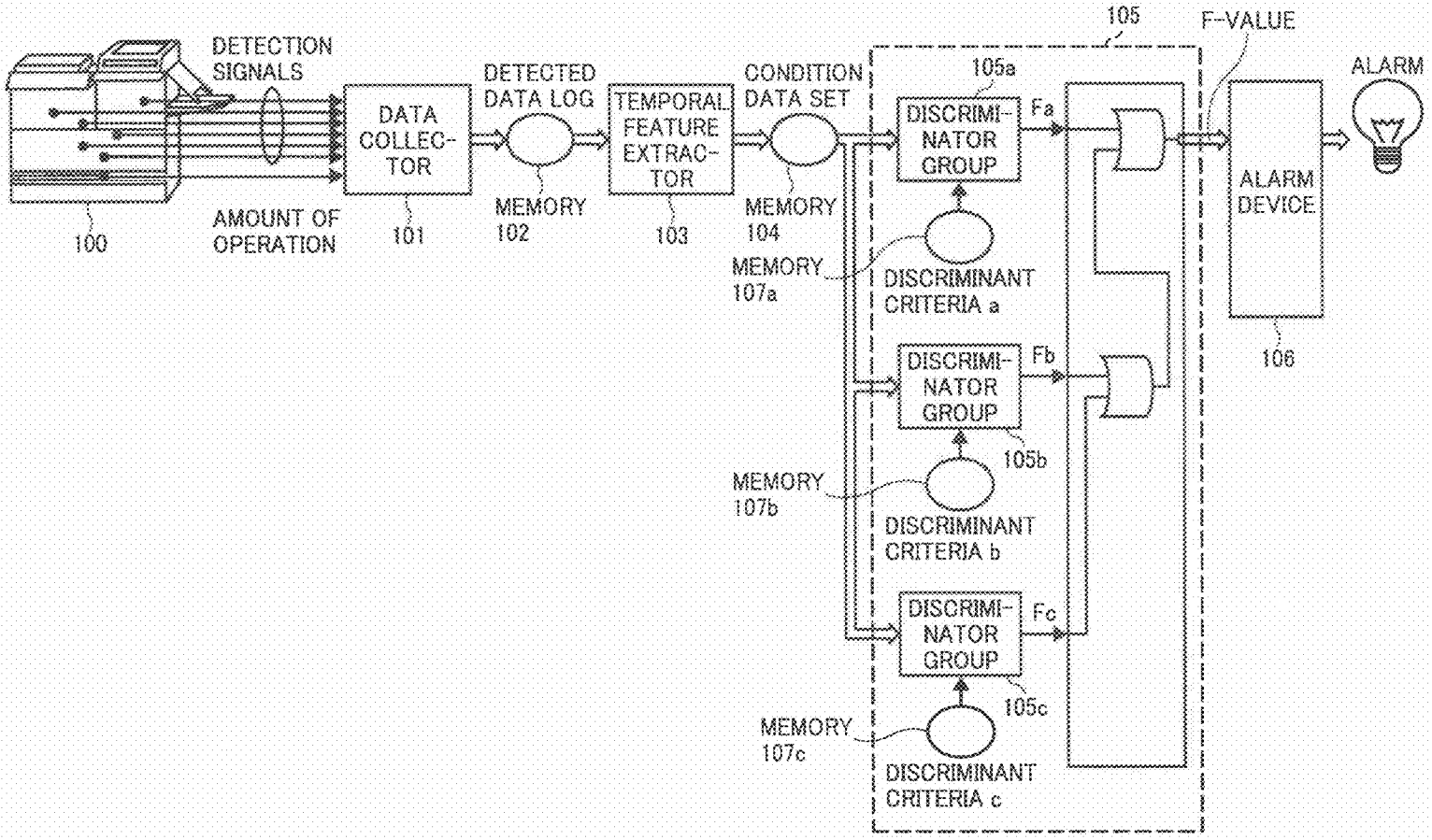
FIG. 19 is a block diagram of a variation of the operation to be performed to notify a user of a prefailure status, in which a discriminator unit includes a plurality of discriminator groups.

Meanwhile, characteristics of changes in the correcting parameters Q of Y, M, and C related to the black cleaning failure vary from one another. Magnitudes, relative ratios, and changing ratios of the changes vary from one test apparatus to another in many cases. Accordingly, the discriminant criteria (αi, sgni, and bi) disadvantageously vary depending on which one of detected data logs of the five test apparatuses is used in the iterative learning. To this end, a plurality of discriminators (hereinafter, "discriminator groups") that perform determination by using discriminant criteria calculated from a plurality sets of detected log data can be used in determination of a prefailure status of the black cleaning failure. The plurality sets of detected log data are generated by iterative learning of detected data collected from a plurality of test apparatuses. More specifically, as depicted in FIG. 19, the discriminator unit 105 can include, for example, three discriminator groups 105*a*, 105*b*, and 105*c*. The discriminator groups 105*a*, 105*b*, and 105*c* perform determination by referring to different discriminant criteria to obtain determination results (values) Fa, Fb, and Fc, respectively. The discriminator unit 105 outputs an F-value, which is the final result of determination, based on the determination results Fa, Fb, and Fc. In a configuration where the discriminator unit 105 includes the discriminator groups 105*a*, 105*b*, and 105*c* that are connected in parallel as depicted in FIG. 19, sufficiently-high accuracy in determination is required of each of the discriminator groups 105*a*, 105*b*, and 105*c*.

The discriminant criteria to be used by the discriminator groups 105*a*, 105*b*, and 105*c* can be generated each time when data is collected from an "appropriate" failure case. However, some of "appropriate" failures do not occur in an operating test performed during the course of product development. In some cases, an "appropriate" failure that has not occurred in the operating test is found from detected data collected from one of the image forming apparatuses 100 having been shipped to users and started on-site operation. In the first embodiment, the managing apparatus 200 collects detection data from the image forming apparatuses 100 shipped to users via the communication network so that discriminant criteria for use in the discriminator groups 105*a*, 105*b*, and 105*c* are updated based on a failure case found among the collected detected data. A discriminator group that uses the updated discriminant criteria can be added to the image forming apparatuses 100. The additional discriminator group can be added by, for example, additionally installing a new discrimination computer program and the discriminant criteria to be used by the discrimination computer program in each of the image forming apparatuses 100 via the communication network. The discrimination computer program causes the CPU of each of the image forming apparatuses 100 to function as the additional discriminator group. Alternatively, a discriminator group that performs determination by using dummy discriminant criteria can be installed in each of the image forming apparatuses 100 in advance. In this case, the additional discriminator group is added to the image forming apparatus 100 by rewriting the dummy discriminant criteria with the new discriminant criteria via the communication network.

Anomaly notification operation, which is a feature of the present invention, will be described below.

When the discriminator unit 105 has detected an anomalous status corresponding to a prefailure status (of the black cleaning failure), the image forming apparatus 100 generally illuminates an alarm lamp to inform of this effect or displays a message such as "prefailure status has been detected" on an operation panel. It is also general that the image forming apparatus 100 causes the indication to be displayed on a personal computer, which is a print-requesting machine, via the communication network by using functions of printer driver software. These notifications such as the illumination of the alarm lamp or displaying the message on the operation panel will be referred to as "anomaly notification". However, in some cases no obvious trouble is found in an image forming apparatus or its printout even when a prefailure status is detected. In this case, a user receives only the anomaly notification and receives no other information that makes the user to convince that the notification is not misinformation but a failure will actually occur in near future. Accordingly, it is possible that the user continues to use the image forming apparatus 100 and ignores the notification to save a trouble of performing maintenance by himself/herself or having the image forming apparatus 100 to be repaired by a service person, or to save the cost incurred in such repair. In such a case, repair of the image forming apparatus 100 is performed after a failure has actually occurred. Because the magnitude of repair at this point in time is in many cases larger than the magnitude of repair at the point in time where the notification has been provided, cost and time (downtime) required for the repair are likely to be increased. It is possible to notify a provider that runs the managing apparatus 200 and that provides the image forming apparatuses about an anomalous status upon detection that one of the image forming apparatuses 100 has fallen into an anomalous status. In this case, the provider can perform maintenance work before the provider receives a request for the maintenance work from a user of the image forming apparatus 100 to prevent occurrence of a failure. However, under this operation scheme, the user is required to pay for a maintenance work on an apparatus that appears to be operating normally. Therefore, because it is hardly expected that a user is willing to pay for the expense of the maintenance work only because a prefailure status is detected, this operation scheme will be difficult to be accepted by users.

Figure 20:
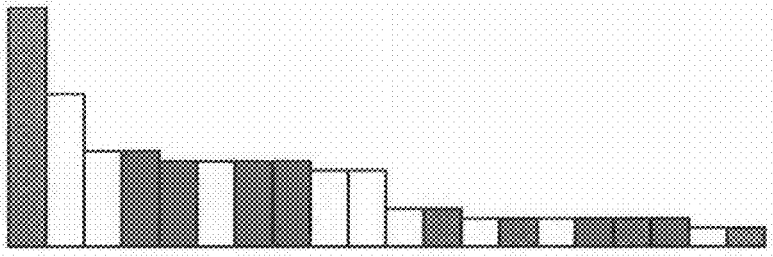
FIG. 20 is a schematic explanatory diagram of a status indicating screen that appears on an operation panel of the image forming apparatus depicted in FIG. 1 when an anomaly notification operation according to the first embodiment is performed.

FIG. 20 is a schematic explanatory diagram of a status indicating screen that appears on the operation panel of the image forming apparatus 100 when the anomaly notification operation according to the first embodiment is performed.

On the status indicating screen, determination results of the multiple weak discriminators of the discriminator unit 105 are displayed in the form of a bar chart. The length of each bar corresponding to a result of one of the weak discriminators represents a relative value of the magnitude of the weight (i.e., weight coefficient) assigned to the determination result. A white bar indicates that a determination result of the weak discriminator corresponding to the bar indicates a normal status while a gray bar indicates that a determination result of the weak discriminator corresponding to the bar indicates an anomalous status. Any colors can be employed for differentiation between an anomalous status and a normal status so long as the colors permit differentiation therebetween; however, it is preferable to utilize a general concept. More specifically, a color that is typically used to represent an anomalous status such as red or yellow is preferably selected for an anomalous status while a color that is typically used to represent a normal status such as blue or green is preferably selected for a normal status. The same holds true for other examples below.

When the determination results of the weak discriminators of the discriminator unit 105 are displayed in the form of a bar chart in this manner, a user can visually comprehend the results as a ratio between a white area that represents the normal status and a gray area that represents the anomalous status. Put another way, the user can visually comprehend how many anomalous statuses are on the screen as compared to normal statuses. The discriminator unit 105 performs majority vote of a sum of weighted results of weak discriminators indicating an anomalous status against a sum of weighted results of weak discriminators indicating a normal status, and outputs an F-value that is a final determination result. When the number of votes for the anomalous status is large, a ratio of the gray area on the status indicating screen increases. At the sight of this display, a user can comprehend that the image forming apparatus 100 is in an anomalous status without conscious deductive effort. This causes the user to expect more seriously that a failure will occur in near future or that necessity of a repair will actually arise than in a case where notification that an anomalous status has been detected is made only by using the alarm lamp or displaying the message. Accordingly, the user is more likely to have a maintenance work before occurrence of a failure.

In the first embodiment, the bars on the bar chart on the status indicating screen are arranged from the left in a descending order of the magnitudes of the weights. However, the bars can be arranged in some other order. The same holds true for other examples below.

A first modification of the anomaly notification operation according to the first embodiment will be described below.

Figure 21:
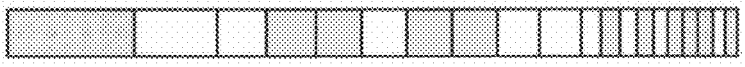
FIG. 21 is a schematic explanatory diagram of a first modification of the status indicating screen that appears on the operation panel when an anomaly notification operation is performed.

FIG. 21 is a schematic explanatory diagram of a status indicating screen that appears on the operation panel of the image forming apparatus 100 according to the first modification. In the first modification, the determination results of the weak discriminators of the discriminator unit 105 are displayed in the form of a stacked bar chart. The length of each bar corresponding to a result of one of the weak discriminators represents a relative value of the magnitude of the weight (i.e., weight coefficient) assigned to the result. A white bar indicates that a determination result of the weak discriminator corresponding to the bar indicates a normal status while a gray bar indicates that a determination result of the weak discriminator corresponding to the bar indicates an anomalous status.

Figure 22A:
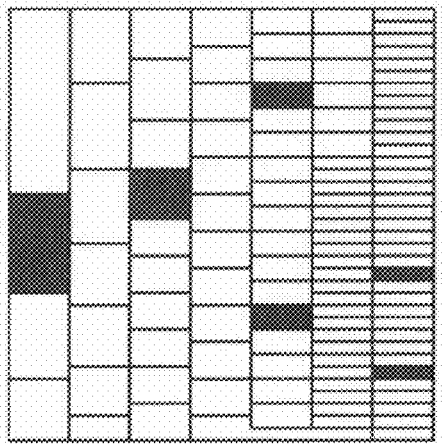
FIGS. 22A and 22B are schematic explanatory diagrams of status indicating screens each of which appears on the operation panel when an anomaly notification operation according to a second modification is performed.
Figure 22B:
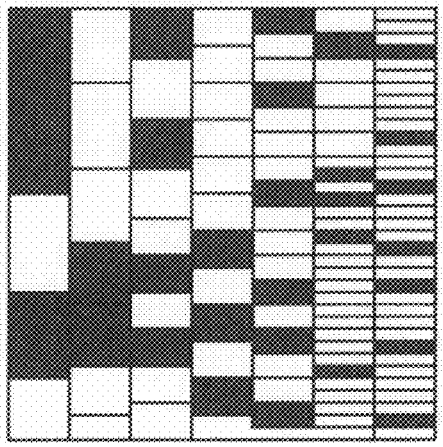

A second modification of the anomaly notification operation according to the first embodiment will be described below. FIGS. 22A and 22B are schematic explanatory diagrams of status indicating screens each of which appears on the operation panel according to the second modification. FIG. 22A depicts an example in which only a small number of weak discriminators have detected an anomalous status and the image forming apparatus 100 has not fallen into a prefailure status yet in its entirety. FIG. 22B depicts an example in which the weak discriminators corresponding to approximately a half of the entire area have detected anomalous statuses. Put another way, it is depicted that the image forming apparatus 100 has fallen into a prefailure status of an alarm level where an alarm requesting a user to perform a maintenance work is to be issued.

In the second modification, a display area on the status indicating screen is segmented such that segments individually represent the determination results of the weak discriminators of the discriminator unit 105. Hence, the determination results are two-dimensionally arranged on the status indicating screen. The rectangular area of each of the weak discriminators represents a relative value of the magnitude of the weight (i.e., weight coefficient) assigned to the determination result. A white area indicates that a determination result of the weak discriminator corresponding to the area indicates a normal status while a gray area indicates that a determination result of the weak discriminator corresponding to the area indicates an anomalous status.

Figure 23:
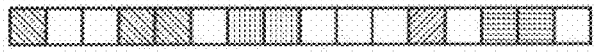
FIG. 23 is a schematic explanatory diagram of a status indicating screen that appears on the operation panel when an anomaly notification operation according to a third modification is performed.

A third modification of the anomaly notification operation according to the first embodiment will be described below. FIG. 23 is a schematic explanatory diagram of a status indicating screen that appears on the operation panel according to the third modification.

In the third modification, each of the determination results of the weak discriminators is displayed in the form of a square block. The square blocks having the same area are aligned horizontally on the status indicating screen. A white block indicates that a determination result of the weak discriminator corresponding to the block indicates a normal status while a gray block indicates that a determination result of the weak discriminator corresponding to the block indicates an anomalous status. The color of each of the blocks other than the white blocks represents a relative value of the magnitude of the weight (i.e., weight coefficient) assigned to the determination result. More specifically, the greater the magnitude of the weight assigned to a weak discriminator, the longer the wavelength of the color of the block corresponding to the weak discriminator while the lower the weight coefficient, the shorter the wavelength of the color. In general, the longer the wavelength of a color, the more impressive the color is. Accordingly, an overall color tone of the status indicating screen leads a user to comprehend that the image forming apparatus 100 is in an anomalous status without conscious deductive effort.

In FIG. 23, different patterns indicate different colors such that the blocks on the left hatched with negative oblique lines indicate red, the blocks in the center hatched with vertical lines indicate yellow, the blocks hatched with positive lines indicate green, and the blocks hatched with horizontal lines indicate blue. As a matter of course, the determination results can be displayed on the status indicating screen by using these different patterns.

In the third modification, the areas of the blocks are equal to one another. However, the areas can differ from one another such that the greater the magnitude of the weight assigned to the corresponding weak discriminator, the greater the area is. In this case, the overall color tone of the status indicating screen indicates the anomalous status of the image forming apparatus 100 more faithfully. Accordingly, a user can comprehend that the image forming apparatus 100 is in an anomalous status more easily without conscious deductive effort.

Figure 24:
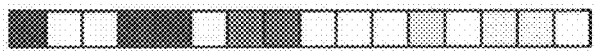
FIG. 24 is a schematic explanatory diagram of a status indicating screen that appears on the operation panel when an anomaly notification operation according to a fourth modification is performed.

A fourth modification of the anomaly notification operation according to the first embodiment will be described below. FIG. 24 is a schematic explanatory diagram of the fourth modification of the status indicating screen that appears on the operation panel.

In the fourth modification, each of the determination results of the weak discriminators is displayed in the form of a square block. The square blocks of the same area are aligned horizontally on the status indicating screen. A white block indicates that a determination result of the weak discriminator corresponding to the block indicates a normal status while a gray (in actual application, red is more preferable) block indicates that a determination result of the weak discriminator corresponding to the block indicates an anomalous status. The color density of each of the gray blocks represents a relative value of the magnitude of the weight (i.e., weight coefficient) assigned to the determination result. More specifically, the greater the magnitude of the weight assigned to a weak discriminator, the thicker the density of the color assigned to the block of the weak discriminator. In general, the thicker the density of a color, the more impressive the color is. Accordingly, an overall color tone of the status indicating screen leads a user to comprehend that the image forming apparatus 100 is in an anomalous status without conscious deductive effort.

In the fourth modification, the areas of the blocks are equal to one another. However, the areas can differ from one another such that the greater the magnitude of the weight assigned to the corresponding weak discriminator, the greater the area is. In this case, the overall color tone of the status indicating screen indicates the anomalous status of the image forming apparatus 100 more faithfully. Accordingly, a user can comprehend that the image forming apparatus 100 is in an anomalous status more easily without conscious deductive effort.

Different luminous intensities can be used in place the different color densities to indicate different magnitudes of the weight.

Figure 25:
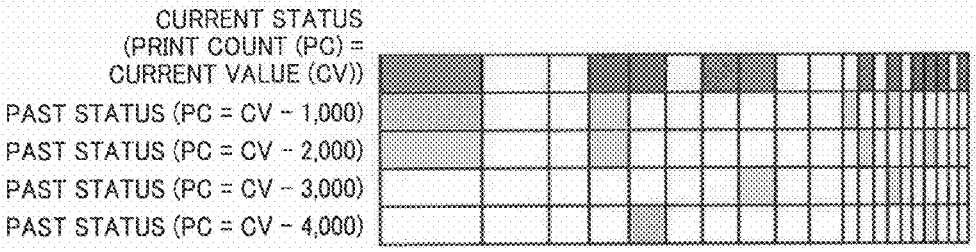
FIG. 25 is a schematic explanatory diagram of a status indicating screen that appears on the operation panel when an anomaly notification operation according to a fifth modification is performed.

A fifth modification of the anomaly notification operation according to the first embodiment will be described below. FIG. 25 is a schematic explanatory diagram of a status indicating screen that appears on the operation panel according to the fifth modification.

It is effective to make a user to comprehend how much the image forming apparatus 100 has deteriorated by comparing the current anomalous status with a normal status of the past. This leads the user to comprehend that the image forming apparatus 100 is in the anomalous status without conscious deductive effort.

In the fifth modification, a current status and past statuses are displayed vertically stacked on the status indicating screen such that a user can compare the current status with the past statuses. As in the first modification, the determination results of the weak discriminators are displayed in the form of a stacked bar chart. The length of each bar corresponding to a result of one of the weak discriminators represents a relative value of the magnitude of the weight assigned to the result. A white bar indicates that a determination result of the weak discriminator corresponding to the bar indicates a normal status while a gray bar indicates that a determination result of the weak discriminator corresponding to the bar indicates an anomalous status. Data for use in displaying the past statuses can be obtained by calculating past status data that has been collected and stored at corresponding past points in time. Examples of the past status data include various collected data pieces (e.g., correcting parameters P and Q), feature values extracted by the temporal feature extractor 103, determination results of the weak discriminators, data that is to be displayed and that is derived from the determination results, and data equivalent to one of these data.

Displaying the current determination result and those of the past such that a user can compare the current anomalous status with normal statuses of the past in this manner causes the user to comprehend that the image forming apparatus 100 has gradually deteriorated. Accordingly, the user can comprehend that the image forming apparatus 100 is currently in the anomalous status as compared with the past status without conscious deductive effort.

On the status indicating screen of the fifth modification, the current status is differentiated from those of the past statuses by utilizing color densities; however, different colors can be used in place of the color densities. Note that it is not necessary to differentiate the current status from the past statuses on the status indicating screen in this manner.

In the fifth modification, the stacked bar chart is employed; however, other representation method can be employed.

Figure 26:
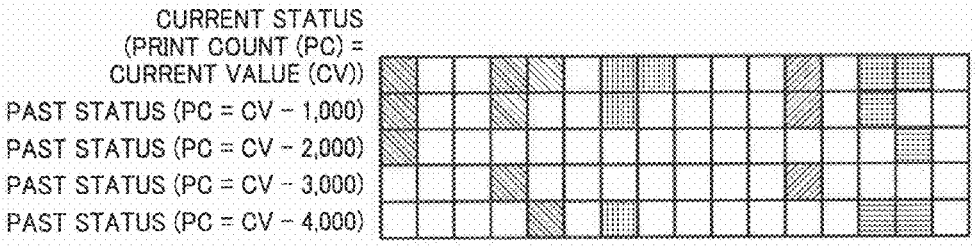
FIGS. 26 to 28 are explanatory diagrams of variations of the status indicating screen according to the fifth modification.

FIG. 26 depicts a variation of the status indicating screen, on which different magnitudes of weight are indicated in different colors.

Figure 27:
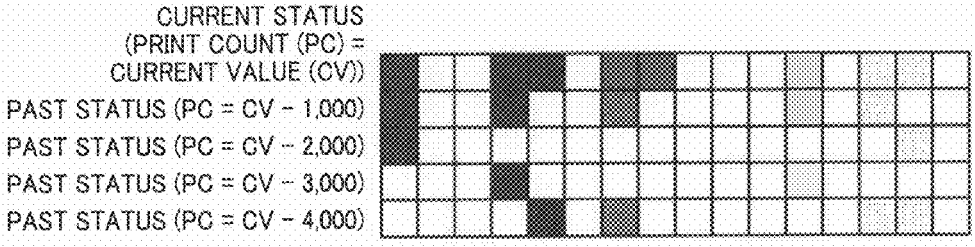

FIG. 27 depicts another variation of the status indicating screen, on which different weight values are indicated in different color densities.

Figure 28:
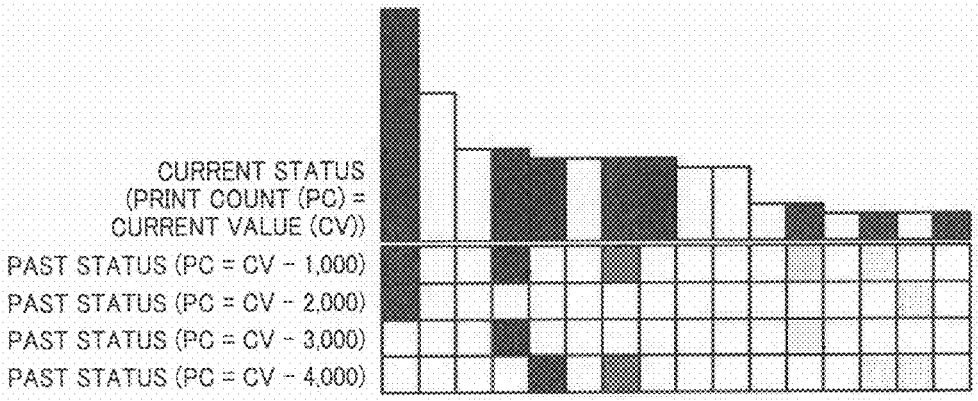

FIG. 28 depicts still another variation of the status indicating screen, in which, as in the fourth modification, different weight values are indicated in different color densities. Furthermore, the current status is displayed in the form of a bar chart in which different lengths of bars represent different weight values. Meanwhile, gradations in color density are an attribute that is less easily visually identifiable as compared to gradations in area, which is another attribute. Accordingly, displaying the current status by utilizing the gradations in area while displaying the past statuses, which are displayed for reference, by utilizing the gradations in color density is effective in enhancing the current status.

As a matter of course, the current status and the past statuses can be simply arranged side by side. For example, the status indicating screens depicted in FIG. 22A and FIG. 22B can be arranged side by side on a single display.

A sixth modification of the anomaly notification operation according to the first embodiment will be described below.

Figure 29A:
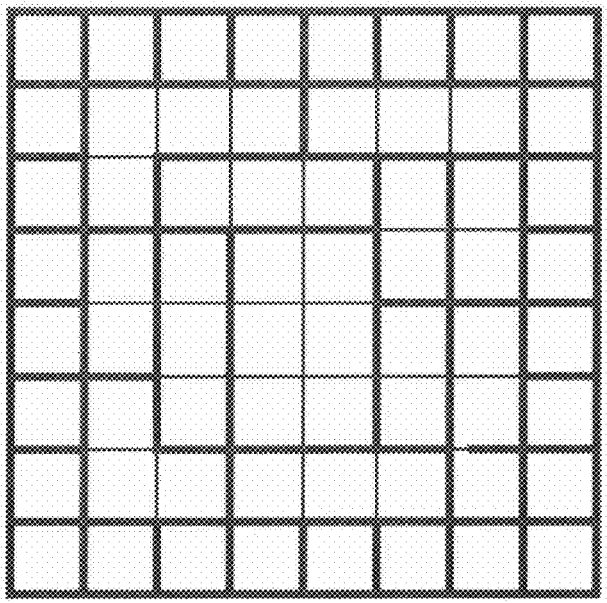
FIGS. 29A and 29B are schematic diagrams for explaining a status indicating screen that appears on a dot matrix display when an anomaly notification operation according to a sixth modification is performed.
Figure 29B:
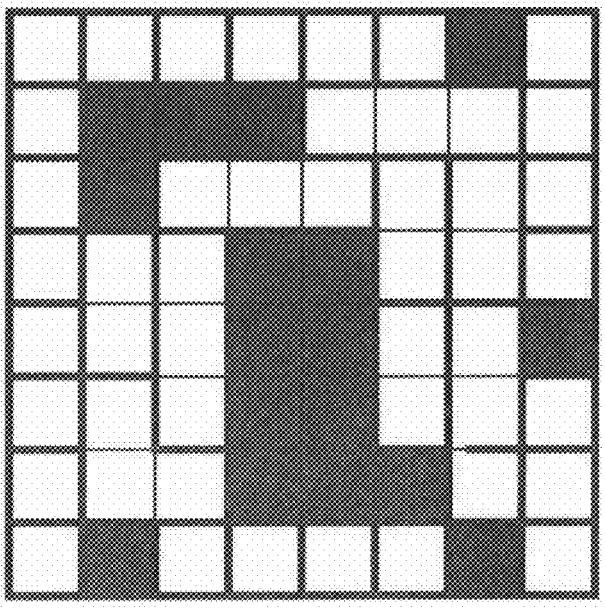

FIGS. 29A and 29B are schematic diagrams for explaining a status indicating screen that appears on a dot matrix display according to the sixth modification.

The dot matrix display includes a matrix of a single-size pixels and displays an image by illuminating appropriate ones of the pixels. In the sixth modification, the number of pixels assigned to a weak discriminator depends on the magnitude of a weight assigned to a result of the weak discriminator. In FIGS. 29A and 29B, segments defined by thick lines individually correspond to the weak discriminators. A white segment indicates that a determination result of the weak discriminator corresponding to the segment indicates a normal status while a gray segment indicates that a determination result of the weak discriminator corresponding to the segment indicates an anomalous status.

Dot matrix displays are widely used as a user interface in various apparatuses such as an image forming apparatus. Displaying the status indicating screen on such an already-provided display advantageously eliminates the need of an additional display dedicated to the anomaly notification.

Using a color display that includes pixels capable of representing RGB colors as the dot matrix display makes it also possible to indicate different magnitudes of weight in different colors as in the third modification.

A current status and past statuses can be displayed on the dot matrix display such that a user can compare the current status with the past statuses as in the fifth modification. Such a display can be attained by, for example, sequentially switching the status displayed on the dot matrix display from one status to another. By switching the status displayed on the screen in this manner, it is possible to show a transitional change in the status of the image forming apparatus 100 in a manner similar to a moving video. Notifying a user about the status of the image forming apparatus 100 in such a representation method is highly effective in causing the user to convince that the status of the image forming apparatus 100 has deteriorated.

In the first embodiment (including the modifications), weights are generally assigned to the weak discriminators as follows. A weight with a large magnitude is assigned to an anomalous status that rarely occurs but highly possibly results in a failure when it occurs; while a weight with a small magnitude is assigned to an anomalous status that has a weak correlation with a failure. When the weights are assigned in this manner, determination results of weak discriminators assigned with weights of similar magnitudes can be arranged close to one another on the display. This arrangement facilitates user's understanding about a circumstance from which the anomaly notification has been issued. More specifically, a user can easily understand whether the anomaly notification has been issued only because accidentally a large number of weak discriminators having weak correlations with failure have detected anomalous statuses or because a weak discriminator having a strong correlation with a failure has detected an anomalous status.

Figure 30:
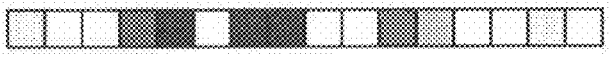
FIG. 30 is a schematic exemplary diagram of a display in which a result assigned with a weight of largest magnitude is arranged at a center and the other results are arranged in descending order of magnitudes of weights toward opposite ends.
Figure 31:
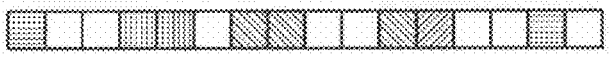
FIG. 31 is a schematic diagram of a variation of the display depicted in FIG. 30.
Figure 32A:
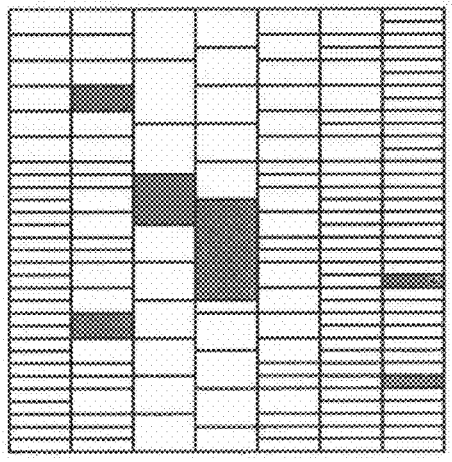
FIGS. 32A and 32B are schematic diagrams of still other variations of the display depicted in FIG. 30.
Figure 32B:
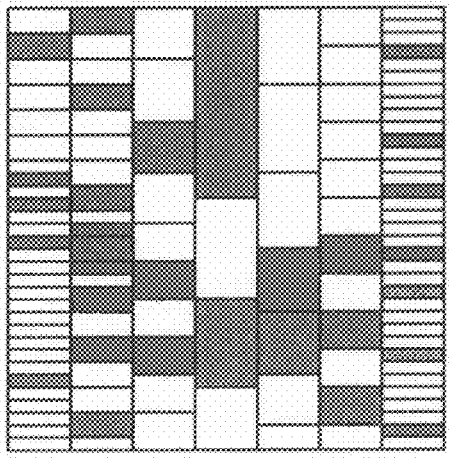

In each of the status indicating screens depicted in FIGS. 20 to 28, the determination results are arranged in descending order of the magnitudes of weights assigned to the results from the left end. Meanwhile, in human vision, the degree of attention is highest at the center and gradually declines toward edges. In view of this, the determination results can be displayed by arranging a result assigned with a weight of largest magnitude at a center of the display and the other results in descending order of the magnitudes of weights toward opposite ends. FIG. 30 is a schematic diagram that depicts a specific example of indicating different weight values in different colors as in the fourth modification. FIG. 31 depicts an example in which different magnitudes of weight are indicated in different color densities as in the third modification. FIGS. 32A and 32B depict examples in which, as in the second modification, determination results of weak discriminators are represented in a two-dimensional matrix. Elements of the matrix represent the determination results. Different areas of the elements represent different magnitudes of weight assigned to the weak discriminators corresponding to the elements.

A status determination system according to a second embodiment of the present invention will be described below.

The status determination system according to the first embodiment displays the status indicating screen based on the determination results of the weak discriminators of the discriminator unit 105 and the magnitudes of weight assigned to the results. In contrast, the status determination system according to the second embodiment displays a status indicating screen based on an F-value. The F-value is an index value calculated by using a sum of weighted "normal" results (the number of votes for normal status) and a sum of weighted "anomalous" results (the number of votes for anomalous status) of weak discriminators. Descriptions about elements of the status determination system according to the second embodiment having already been described in the first embodiment are omitted.

Figure 33A:
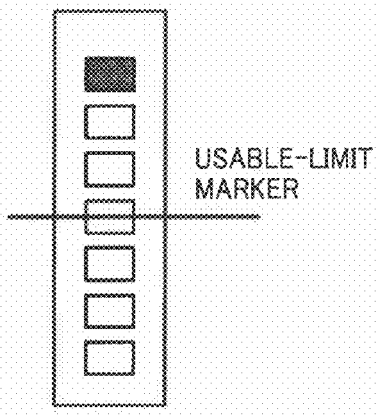
FIGS. 33A to 33C are schematic explanatory diagrams of status indicating screens each of which appears on the operation panel of the image forming apparatus when an anomaly notification operation according to a second embodiment is performed.
Figure 33B:
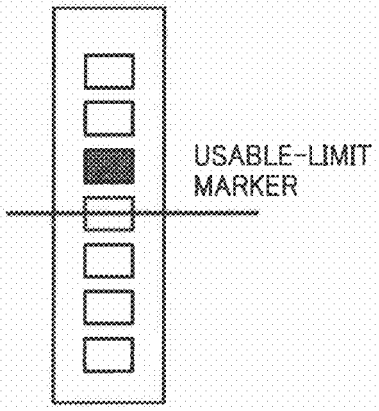
Figure 33C:
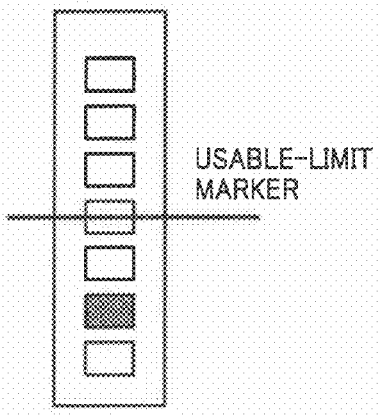

FIGS. 33A to 33C are explanatory diagrams of status indicating screens each of which appears on the operation panel when anomaly notification operation according to the second embodiment is performed.

A seven-level indicator that indicates a current F-value in seven levels is arranged on the status indicating screen. The higher the level of an F-value is, the closer the status indicated by the F-value is to a normal status. In each of FIGS. 33A to 33C, a current level of the F-value is indicated in black. FIG. 33A depicts that the image forming apparatus 100 is in a quite normal status where determination results of most of the weak discriminators are "normal". FIG. 33B depicts that the image forming apparatus 100 is in a normal status but determination results of some weak discriminators to which relatively small weights are assigned are "anomalous". FIG. 33C depicts that the image forming apparatus 100 is determined to be in an anomalous status where determination results of a sufficiently large number of weak discriminators or a determination result of a weak discriminator to which sufficiently-large weight is assigned is "anomalous". In the second embodiment, a usable-limit marker is additionally displayed on the status indicating screen. The usable-limit marker is a zero point, or a decision boundary, of the majority vote based on the F-value. The usable-limit marker helps a user to comprehend how much the image forming apparatus 100 has deteriorated.

Displaying the F-value, which is the index value for use in the majority vote, in this manner causes a user to visually comprehend how much the image forming apparatus 100 has deteriorated. This leads the user to comprehend that the image forming apparatus 100 is in an anomalous status without conscious deductive effort. Hence, the user comes to expect more seriously that a failure will occur in near future or that necessity of a repair will actually arise than in a case where notification that an anomalous status has been detected is made only by using the alarm lamp or displaying a message. Accordingly, the user is more likely to have a maintenance work before occurrence of a failure.

Furthermore, in the second embodiment, the usable-limit marker, which is the decision boundary of the majority vote, is displayed together with the F-value. This provides information about how much time is allowed before the image forming apparatus 100 is determined to be anomalous.

In the second embodiment, the F-value is displayed in seven levels; however, the number of the levels is not limited to seven. A minimum number of the levels necessary to cause a user to comprehend that the image forming apparatus 100 is in an anomalous status without conscious deductive effort is three. The same holds true for other examples below.

A modification of the anomaly notification operation according to the second embodiment (hereinafter, "seventh modification") will be described below.

Figure 34:
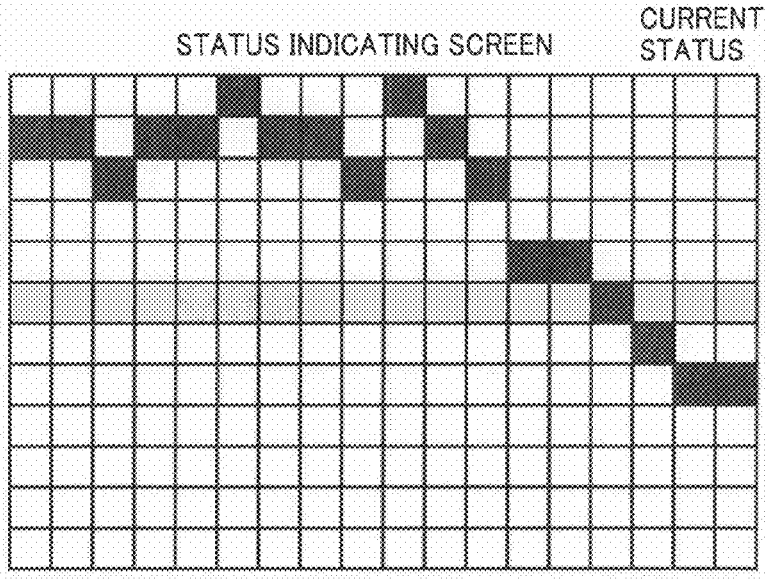
FIG. 34 is a schematic explanatory diagram of a status indicating screen that appears on the operation panel when an anomaly notification operation according to a seventh modification is performed.

FIG. 34 is a schematic explanatory diagram of a status indicating screen that appears on the operation panel according to the seventh modification.

It is effective to make a user to comprehend how much the image forming apparatus 100 has deteriorated by comparing a current anomalous status with normal status of the past. This leads the user to comprehend that the image forming apparatus 100 is in the anomalous status without conscious deductive effort.

On the status indicating screen according to the seventh modification, statuses of different times are arranged in time series from the left so that a user can compare the current status with the past statuses. An F-value is displayed in 12 levels for each of the statuses. The higher the level of an F-value is, the more the status indicated by the F-value approaches a normal status. The current level of the F-value is indicated in black. A zero point, which is a decision boundary of the majority vote based on the F-value, is indicated in gray.

Displaying the F-values such that a user can compare a current F-value with past F-values in this manner causes a user to comprehend that the image forming apparatus 100 has gradually deteriorated. This leads the user to comprehend that the image forming apparatus 100 is currently in the anomalous status as compared with the past status without conscious deductive effort.

Another modification of the anomaly notification operation according to the second embodiment (hereinafter, "eighth modification") will be described below.

Figures 35A, 35B, 35C:
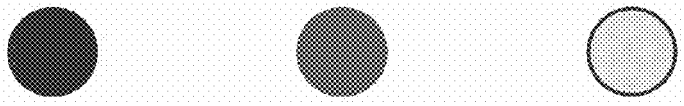
FIGS. 35A to 35C are schematic explanatory diagrams for explaining how an alarm lamp arranged on the image forming apparatus illuminates in response to an anomaly notification operation according to an eighth modification.
Figures 36A, 36B, 36C:
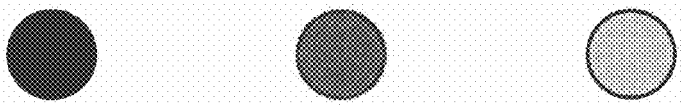
FIGS. 36A to 36E are schematic explanatory diagrams for explaining how an alarm lamp arranged on the image forming apparatus illuminates in response to an anomaly notification operation according to a ninth modification.
Figures 36D, 36E:
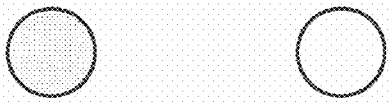

FIGS. 35A to 35C are schematic explanatory diagrams for explaining how an alarm lamp arranged on the image forming apparatus 100 illuminates in response to an anomaly notification operation according to the eighth modification.

In the eighth modification, the status of the image forming apparatus 100 is displayed more simply by using luminous intensities of the alarm lamp, which is a blue lamp in this example. The blue lamp is illuminated such that the closer the image forming apparatus 100 is to a normal status, the higher the luminous intensity of the blue lamp is. More specifically, when the luminous intensity of the blue lamp is high as depicted in FIG. 35A, determination results of most of the weak discriminators indicate a normal status. When the luminous intensity of the blue lamp is moderate as depicted in FIG. 35B, the image forming apparatus 100 is in a normal status but determination results of some weak discriminators assigned with relatively small weights indicate an anomalous status. When the luminous intensity of the blue lamp is low as depicted in FIG. 35C, the image forming apparatus 100 is in a normal status but in close proximity of a zero point. The zero point is a decision boundary of majority vote based on the F-value.

A user who has visually recognized that the luminous intensity indicative of a normal status has decreased can comprehend that the image forming apparatus 100 has deteriorated without conscious deductive effort.

According to the eighth modification, because the alarm lamp does not illuminate any more when the F-value has fallen below zero, notification to a user of this effect can be achieved without indicating the zero point.

A similar effect can be obtained by changing an average luminous intensity of the lamp depending on the magnitude of the F-value. For example, the average luminous intensity can be decreased by changing flashing frequency of the lamp.

A still another modification of the anomaly notification operation according to the second embodiment (hereinafter, "ninth modification") will be described below.

FIGS. 36A to 36E are schematic explanatory diagrams for explaining how an alarm lamp arranged on the image forming apparatus 100 illuminates in response to an anomaly notification operation according to the ninth modification.

In FIGS. 36A to 36E, different colors are indicated in different densities. More specifically, FIGS. 36A, 36B, 36C, 36D, and 36E depict alarm lamps illuminating in red, green, yellow, orange, and red, respectively. As a matter of course, these different densities can be used in place of or in addition to different colors. The alarm lamp illuminating in blue indicates a most normal status. The alarm lamp illuminating in green indicates that the image forming apparatus 100 is in a normal status but determination results of some weak discriminators assigned with relatively small weights indicate an anomalous status. The alarm lamp illuminating in yellow indicates that the F-value is approximately at the zero point. The alarm lamp illuminating in orange indicates an anomalous status where the F-value has fallen below the zero point. The alarm lamp illuminating in orange indicates a quite anomalous status where the F-value is far below the zero point.

Because the F-value is indicated in colors including blue, yellow, and red that are broadly accepted as colors of traffic lights, it is possible to inform a user of a status of the image forming apparatus 100 without particular explanation. It is also possible to flash or increase luminous intensity of the lamp when the lamp is illuminated in yellow, orange, or red to call more attention.

A still another modification of the anomaly notification operation according to the second embodiment (hereinafter, "tenth modification") will be described below.

Figure 37:
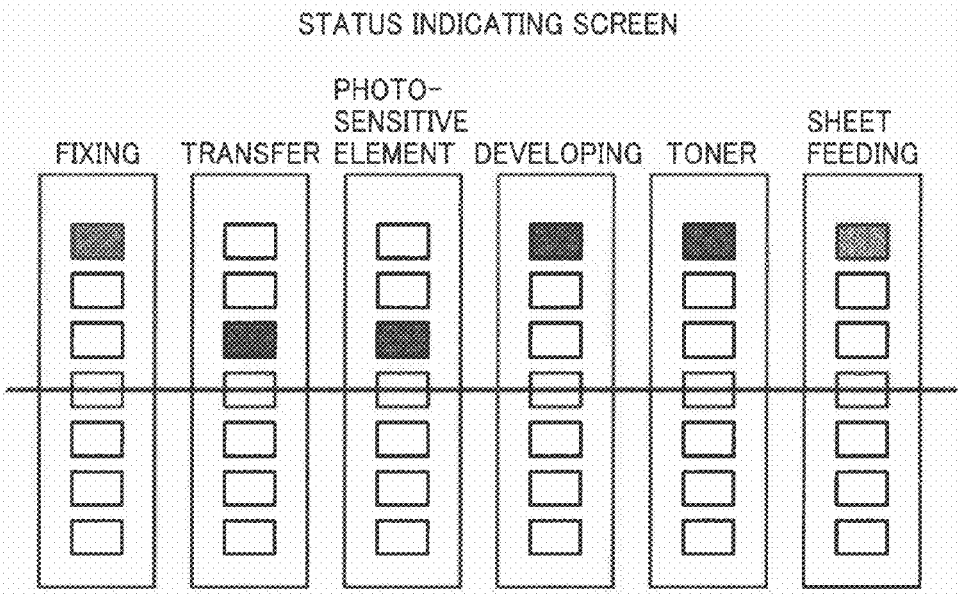
FIG. 37 is a schematic explanatory diagram of a status indicating screen that appears on the operation panel when an anomaly notification operation according to a tenth modification is performed.

FIG. 37 is a schematic explanatory diagram of the status indicating screen that appears on the operation panel when the anomaly notification operation is performed.

The image forming apparatus 100 includes a plurality of subsystems such as a photosensitive element, a developing device, a toner supplying device, a transfer device, a sheet feeding device, and a fixing device. These subsystems cooperate to perform an image forming operation. It is possible to predict occurrence of a failure of each subsystem based on a result as to whether the subsystem is in an anomalous status. For example, the sheet feeding device controls delivery of a sheet of recording medium so that the sheet reaches the transfer device in a predetermined period of time. The status of the sheet feeding device can be determined by monitoring a control value, such as a drive time or a rotation number of a motor related to the sheet feeding operation. The toner supply device controls an amount of toner supply. Similarly, the developing device controls an agitation power while the transfer device controls a transfer current value and the fixing device controls a fixing temperature. Accordingly, by performing majority vote based on an F-value of one of whether each of the subsystems is in an anomalous status or a normal status can be determined as follows. Weak discriminators determine whether each of various control statuses is in an anomalous status based on a corresponding one type of a plurality of types of status data. An F-value is calculated from determination results of the weak discriminators for each of the control statuses. Whether the subsystem is in an anomalous status is determined by majority vote based on the F-value.

Seven-level indicators that individually correspond to the subsystems are arranged on the status indicating screen of the tenth modification. Each of the seven-level indicators indicates a current level of an F-value of the corresponding subsystem in seven levels as in the second embodiment. This status indicating screen permits a user to visually comprehend how much each of the subsystems has deteriorated at a glance, thereby permitting the user to comprehend an overall status of the image forming apparatus 100.

As a matter of course, it is possible to display the statuses independently on a corresponding number of screens rather than displaying the statuses collectively on the single screen.

Figure 38:
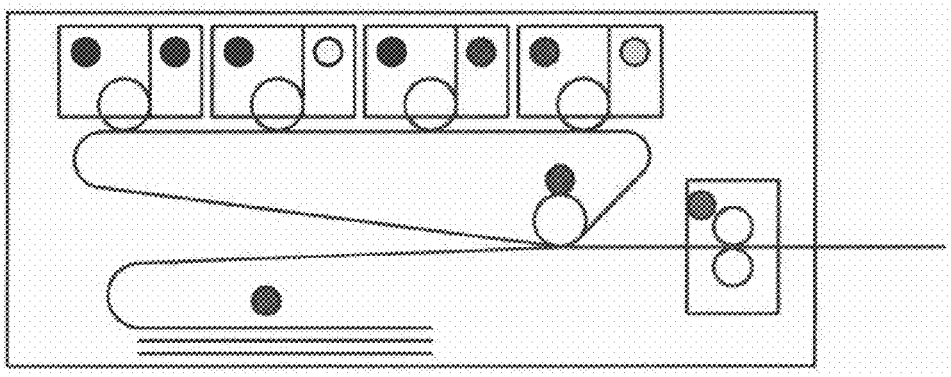
FIG. 38 is a schematic explanatory diagram for explaining how alarm lamps illuminate to indicate statuses of subsystems.

Statuses of the subsystems can be indicated by using lamps arranged at corresponding positions of the image forming apparatus 100. FIG. 38 is a schematic explanatory diagram for explaining how alarm lamps illuminate to indicate the statuses of the subsystems. The statuses can be indicated as in the ninth modification, for example.

Figure 39:
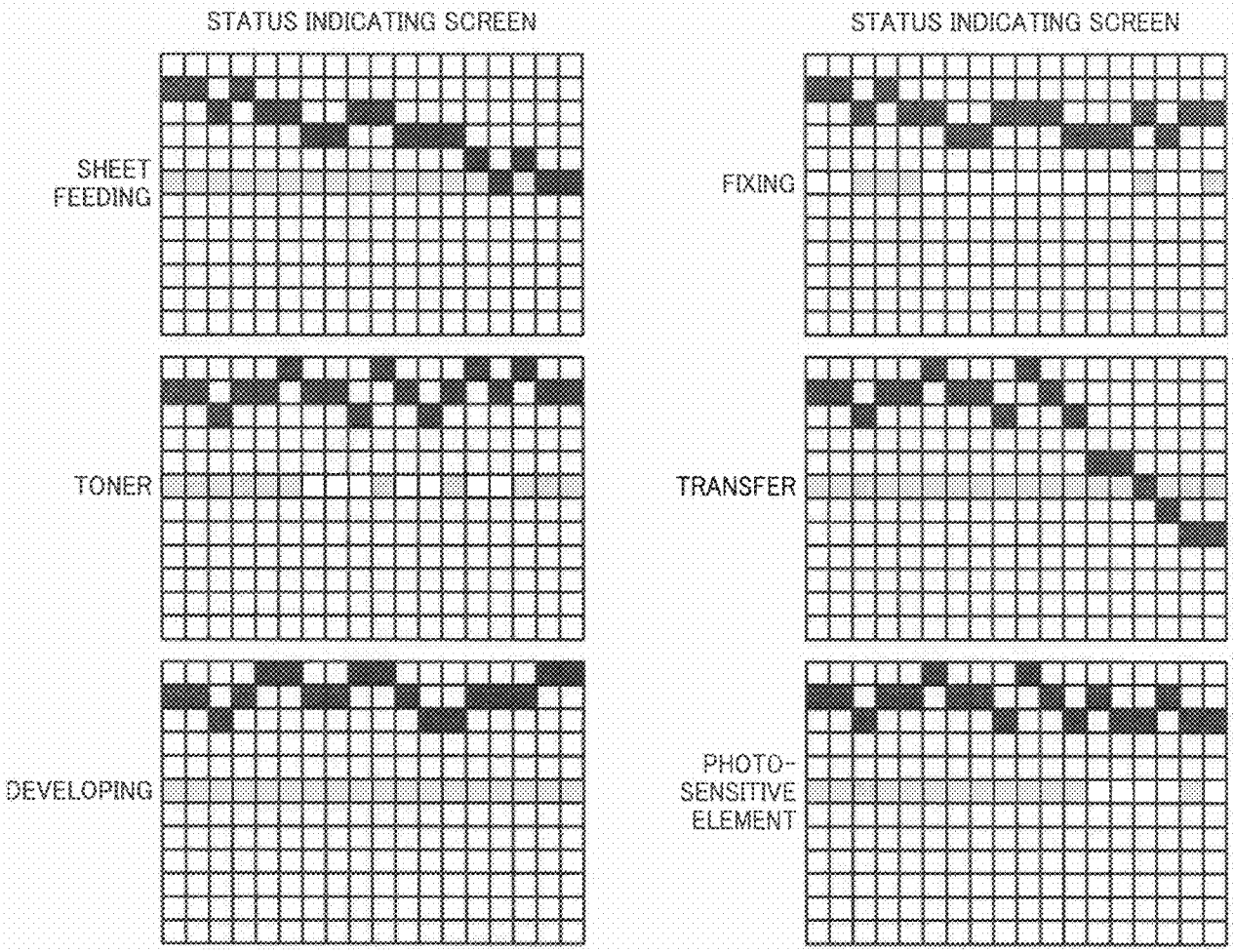
FIG. 39 is a schematic explanatory diagram of a status indicating screen that appears on the operation panel to indicate statuses of subsystems of the image forming apparatus.

Alternatively, the statuses of the subsystems can be indicated as depicted in FIG. 39. In this example, a user can visually compare a current anomalous status with normal statuses of the past and comprehend how much each of the subsystems has deteriorated. The statuses can be displayed as in the seventh modification, for example. In this case, the statuses of the subsystems can be displayed on an LCD or the like such that the status displayed on the LCD is switched from one status to another in time sequence.

According to an aspect of the present invention, a status of the image forming apparatus 100 is determined based on a plurality of types of status data (including the bias-potential correcting parameter Q), and a result of the determination is output. The status data is collected at a plurality of points in time. Feature values, each of which corresponds to a change over time in one type of the status data, are calculated from the status data. Multiple determination operations are performed by using any one of a plurality of first weak discriminators and a plurality of second weak discriminators. The first weak discriminator determines whether status data corresponding to a single feature value of the feature values indicates an anomalous status or a normal status by referring to one of different discriminant criteria. The second weak discriminator determines whether status data corresponding to a feature value group that includes at least two different feature values of the feature values indicates an anomalous status or a normal status by referring to one of different discriminant criteria. Whether the status is in an anomalous status or a normal status is determined by assigning a weight value to each of the determination results and performing majority vote of the weighted determination results. The weight values have been individually determined in advance. In the majority vote, which ones of weighted determination results indicating the anomalous status and weighted determination results indicating the normal status are majority is determined.

The determination results are displayed on a single display area such that the determination results indicating the anomalous status are visually differentiated from the determination results indicating the normal status. The determination results are displayed differently depending on magnitudes of the weight values assigned to the determination results. Accordingly, a user can easily comprehend by viewing the display that whether a portion indicating an anomalous status is of a relatively great importance (assigned with a large weight value) or of a relatively small importance (assigned with a small weight value). At the sight of this display, a user can comprehend that the image forming apparatus 100 is in an anomalous status without conscious deductive effort. This causes the user to expect more seriously that a failure will occur in near future or that necessity of a repair will actually arise than in a case where notification is provided only by using an alarm lamp or displaying a message. Accordingly, the user is more likely to have a maintenance work before occurrence of a failure. In short, even when no trouble manifests itself yet, a user is advantageously more likely to perform a maintenance work by being notified of a prefailure status.

According to another aspect, the determination results are displayed such that a user can compare between a part of the determination results pertaining to a current status and other part of the determination results pertaining to a past status. Accordingly, a user can comprehend that the image forming apparatus 100 has gradually deteriorated and whether the image forming apparatus 100 is currently in the anomalous status as compared with the past status without conscious deductive effort.

According to still another aspect, the determination results are displayed on a dot matrix display. This advantageously eliminates the need of an additional display dedicated to the notification of the anomalous status.

According to still another aspect, the determination results are displayed such that a display area of each of the determination results depends on the magnitude of the weight value assigned to the determination result. Put another way, the larger the area, the larger the magnitude of the weight of the weak discriminator corresponding to the area. Accordingly, a user can comprehend the status of the image forming apparatus 100 more faithfully.

According to still another aspect, different determination results are displayed in different colors depending on the weight values assigned to the determination results. Accordingly, a user can comprehend that the image forming apparatus is in an anomalous status from the overall color tone of the status indicating screen without conscious deductive effort.

According to still another aspect, different determination results are displayed in different luminous intensities or color densities that depend on the magnitudes of the weight values assigned to the determination results. Accordingly, a user can comprehend that the image forming apparatus is in an anomalous status from the overall color tone of the status indicating screen without conscious deductive effort.

According to still another aspect, each of the determination results are displayed at positions that depend on the magnitudes of the weight values assigned to the determination results. Accordingly, a user can easily comprehend a circumstance where an anomaly notification is issued. More specifically, the user can understand whether only accidentally a large number of weak discriminators having weak correlations with failure have detected anomalous statuses or a weak discriminator having a strong correlation with a failure has detected an anomalous status.

According to still another aspect, a status of the apparatus is indicated based on an index value, or an F-value, that is calculated from a sum of the weighted determination results indicating anomalous statuses and a sum of the weighted determination results indicating normal statuses. The F-value indicates a detailed result (whether the value of the majority was greater than that of the minor by a wide margin or a narrow margin) of final determination by the majority vote. Accordingly, when the result of the majority vote is "anomalous", a user who viewed the display by using the F-value can comprehend that the majority vote has been determined by a large margin. This causes the user to expect more seriously that a failure will occur in near future or that necessity of a repair will actually arise than in a case where notification is provided only by using an alarm lamp or displaying a message. Accordingly, the user is more likely to have a maintenance work before occurrence of a failure.

According to still another aspect, the determination results are displayed such that a user can compare between a status by using a past index value and a status by using a current index value. Accordingly, a user can comprehend that the image forming apparatus 100 has gradually deteriorated as well as whether the image forming apparatus 100 is currently in the anomalous status as compared with the past status without conscious deductive effort.

According to still another aspect, the determination results are displayed based on the F-value together with a zero point that is a decision boundary of the majority voting. This provides information to a user about how much time is allowed before the image forming apparatus 100 is determined to be anomalous even when the image forming apparatus 100 is determined to be currently in a normal status.

According to still another aspect, the determination results are displayed with different luminous intensities or color densities that depend on the F-values. Accordingly, a user can comprehend that the image forming apparatus 100 is in an anomalous status at the sight of the display without conscious deductive effort.

According to still another aspect, the determination results are displayed in different colors that depend on the F-values. Accordingly, a user can comprehend that the image forming apparatus 100 is in an anomalous status at the sight of the display without conscious deductive effort.

According to still another aspect, statuses of a plurality of types of status based on F-values are displayed on a single display area. Accordingly, a user can collectively comprehend which one of the statuses is in an anomalous status and how much the status has deteriorated.

In particular, when the types of the status to be displayed on the display area correspond to statuses of a plurality of subsystems of the image forming apparatus 100, a user can comprehend not only individual statuses of the statuses but also an overall status of the image forming apparatus 100.

According to still another aspect, the weak discriminators that compare a feature value with a predetermined threshold value to determine whether status data corresponding to the feature value indicates an anomalous status are embodied by using relatively less expensive decision stumps.

This phenomenon that a change in status of an apparatus occurs before a failure actually occurs in the apparatus is common among various apparatuses. Accordingly, this approach is expected to exert a similar effect on various apparatuses.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A status determination method of determining a status of an apparatus and outputting a result of determination, the status determination method comprising:

collecting a plurality of types of status data indicative of current status of the apparatus at a plurality of points in time;

calculating a feature value from each of the status data, the feature values corresponding to a change over time in corresponding status data;

performing multiple determination operations to output multiple determination results, the multiple determination operations being performed by using any one of determining whether status data corresponding to a single target feature value among the feature values indicates an anomalous status or a normal status by using different discriminant criteria to obtain a determination result, and determining whether status data corresponding to a plurality of target feature values among the feature values indicates an anomalous status or a normal status by using different discriminant criteria to obtain a determination result;

majority voting including assigning a weight value to each of the determination results obtained at the performing to obtain weighted determination results, the weight values being determined in advance, performing majority vote to determine which ones of the weighted determination results indicating the anomalous status and the normal status are in majority, and determining whether the apparatus is in an anomalous status or a normal status according to the weighted determination results that is determined to be in majority at the performing majority vote; and displaying the determination results obtained at the performing on a single display area such that the determination results indicating the anomalous status are visually differentiated from the determination results indicating the normal status, wherein the determination results are displayed differently depending on magnitudes of the weight values assigned to the determination results.

2. The status determination method according to claim 1, wherein the displaying includes displaying the determination results in a manner that permits comparison between a part of the determination results pertaining to a current status and other part of the determination results pertaining to a past status.

3. The status determination method according to claim 1, wherein the displaying includes displaying the determination results on a dot matrix display.

4. The status determination method according to claim 1, wherein the displaying further includes displaying the determination results such that a display area of each of the determination results depends on the magnitude of the weight value assigned to the determination result.

5. The status determination method according to claim 1, wherein the displaying further includes displaying the determination results such that a display color of each of the determination results depends on the magnitude of the weight value assigned to the determination result.

6. The status determination method according to claim 1, wherein the displaying further includes displaying the determination results such that a display luminous intensity or a color density of each of the determination results depends on the magnitude of the weight value assigned to the determination result.

7. The status determination method according to claim 1, wherein the displaying further includes displaying the determination results at positions that depend on the magnitudes of the weight values assigned to the determination results.

8. The status determination method according to claim 1, wherein at least one of the determining performed at the performing multiple determination includes determining whether the status data indicates an anomalous status or a normal status based on comparison of the target feature value or the target feature values with a predetermined threshold value.

9. A status determination method of determining a status of an apparatus and outputting a result of determination, the status determination method comprising:

collecting a plurality of types of status data indicative of current status of the apparatus at a plurality of points in time;

calculating a feature value from each of the status data, the feature values corresponding to a change over time in corresponding status data;

performing multiple determination operations to output multiple determination results, the multiple determination operations being performed by using any one of determining whether status data corresponding to a single target feature value among the feature values indicates an anomalous status or a normal status by using different discriminant criteria to obtain a determination result, and determining whether status data corresponding to a plurality of target feature values among the feature values indicates an anomalous status or a normal status by using different discriminant criteria to obtain a determination result;

majority voting including assigning a weight value to each of the determination results obtained at the performing to obtain weighted determination results, the weight values being determined in advance, performing majority vote to determine which ones of the weighted determination results indicating the anomalous status and the normal status are in majority, and determining whether the apparatus is in an anomalous status or a normal status according to the weighted determination results that is determined to be in majority at the performing majority vote; and displaying a status of the apparatus based on an index value that is calculated from a sum of the weighted determination results indicating the anomalous status and a sum of the weighted determination results indicating the normal status.

10. The status determination method according to claim 9, the displaying includes displaying the determination results in a manner that permits comparison between a status by using a past index value and a status by using a current index value.

11. The status determination method according to claim 9, the displaying includes displaying the status of the apparatus together with a zero point that is a decision boundary of the majority voting.

12. The status determination method according to claim 9, the displaying includes displaying the status of the apparatus such that a luminous intensity and a color density of the display depends on the index value.

13. The status determination method according to claim 9, the displaying includes displaying the status of the apparatus in a color that depends on the index value.

14. The status determination method according to claim 9, the displaying includes displaying a plurality of types of the status of the apparatus based on index values that are individually calculated for the plurality of types of the status.

15. The status determination method according to claim 14, wherein the plurality of types of the status individually correspond to statuses of a plurality of subsystems of the apparatus.

16. The status determination method according to claim 9, wherein at least one of the determining performed at the performing multiple determination includes determining whether the status data indicates an anomalous status or a normal status based on comparison of the target feature value or the target feature values with a predetermined threshold value.

17. An image forming apparatus comprising a status determining unit that determines a status of the image forming apparatus and outputs a result of determination, the status determining unit comprising:

an information collecting unit that collects a plurality of types of status data indicative of current status of the image forming apparatus at a plurality of points in time;

a feature-value calculating unit that calculates a feature value from each of the status data, the feature values corresponding to a change over time in corresponding status data;

a multiple-determination unit that performs multiple determination operations to output multiple determination results, the multiple determination operations being performed by using any one of a first determining unit that determines whether status data corresponding to a single target feature value among the feature values indicates an anomalous status or a normal status by using different discriminant criteria to obtain a determination result, and a second determining unit that determines whether status data corresponding to a plurality of target feature values among the feature values indicates an anomalous status or a normal status by using different discriminant criteria to obtain a determination result;

a majority-voting unit that assigns a weight value to each of the determination results obtained by the multiple-determination unit to obtain weighted determination results, the weight values being determined in advance, performs majority vote to determine which ones of the weighted determination results indicating the anomalous status and the normal status are in majority, and determines whether the image forming apparatus is in an anomalous status or a normal status according to the weighted determination results that is determined to be in majority; and a displaying unit that displays a status of the image forming apparatus based on an index value that is calculated from a sum of the weighted determination results indicating the anomalous status and a sum of the weighted determination results indicating the normal status.

* * * * *